US006599363B2

(12) United States Patent
Narita

(10) Patent No.: US 6,599,363 B2
(45) Date of Patent: Jul. 29, 2003

(54) COATING FILM TRANSFER TOOL AND METHOD FOR REPLACING COATING FILM TRANSFER TAPES

(75) Inventor: Yasuo Narita, Tokyo (JP)

(73) Assignee: Plus Stationery Corporation, Tokyo (JP)

( * ) Notice: Subject to any disclaimer, the term of this patent is extended or adjusted under 35 U.S.C. 154(b) by 0 days.

(21) Appl. No.: 10/166,614

(22) Filed: Jun. 12, 2002

(65) Prior Publication Data

US 2003/0047286 A1 Mar. 13, 2003

(30) Foreign Application Priority Data

Sep. 11, 2001 (JP) ..... 2001-275634

(51) Int. Cl.[7] ..... B05C 17/10

(52) U.S. Cl. ..... 118/76; 118/257; 156/577; 156/579; 242/588.3

(58) Field of Search ..... 118/76, 257; 156/577, 156/579; 242/588.3; 400/695, 696, 700

*Primary Examiner*—Laura Edwards
(74) *Attorney, Agent, or Firm*—Swidler Berlin Shereff Friedman

(57) ABSTRACT

An object of the present invention is to provide a coating film transfer tool which can easily implement the replacement of coating film transfer tapes with as few operations as possible. In a coating film transfer tool according to the present invention, a main body case is provided which is divided into two separate case members, and the case members are disposed such that one of the two case members is manually rotated relative to the other case member. Then, provided on the one of the case members are a head retaining body adapted to be interlocked with the operation of the one case member for rotation, a supply reel to which a coating film transfer tape is detachably attached, a take-up reel around which a coating film transfer tape that has been used up is wound and a transfer mechanism for interlocking the supply reel and the take-up reel.

13 Claims, 22 Drawing Sheets

COATING FILM TRANSFER TOOL AND METHOD FOR REPLACING COATING FILM TRANSFER TAPES

BACKGROUND OF THE INVENTION

1. Field of the Invention

The present invention relates to the construction of a coating film transfer tool for use in transferring a transfer layer provided on one side of a tape in a strippable state to a coating film receiving surface, and more particularly to a coating film transfer tool which can easily attain the replacement of a coating film transfer tape that has been used up with as few operations as possible.

2. Description of the Related Art

Conventionally, a plurality of types of coating film transfer tools have been devised for use in transferring repairing paint or an adhesive layer to the surface of a piece of paper or the like.

These coating film transfer tools are mainly divided into products of a disposable type and products of a replaceable type in which a coating film transfer tape that has been used up is replaced with a refill coating film transfer tape for reusing the tool. With products like those of the former disposable type, since the internal construction of the coating film transfer tool can be made simple, products can be produced and provided at relatively low cost but lots of wastes are produced. Thus, there has existed a problem from viewpoints of conservation of resources and reduction in amount of wastes to be discharged.

To this end, in recent years attention is paid to coating film transfer tools of the replaceable or refilling type, but the following problems are provided by products currently sold in the market place.

Since the refilling type coating film transfer tool is intended to conserve the resources and to reduce wastes, it is ideal that only a used-up coating film transfer tape is replaced with no other accessory members existing which are to be replaced together with the used-up tape. However, since the replacement of only the coating film transfer tape is difficult to be implemented by the user with ease, in practice, certain members have to be replaced together with the used-up coating film transfer tape. Looking carefully at products currently marketed discloses the fact that quite a lot of constituent members are practically replaced together with a used-up coating film transfer tape, although it is desirable that the number of constituent members to be replaced together with a used-up coating film transfer tape is as low as possible.

For example, FIG. 21 shows a refill coating film transfer tape 800 according to an invention disclosed in Japanese Unexamined Patent Publication No. 6-286927. To explain specifically with reference thereto, conventionally there have been marketed many products in which a coating film transfer tape is provided as a cartridge with a view to facilitating the replacement of coating film transfer tapes. In such a product, normally replaced are a coating film transfer tape 805, a core 801 for the coating film transfer tape, a take-up reel 802, a cartridge base 803, a transfer head 804 and the like. To observe the operation of the coating film transfer tape here, the coating film transfer tape is supplied by the supply reel, a coating film is transferred by the head and the transfer film is taken up by the take-up reel. Since these operations are carried out in a series fashion, it is true that constituent members related to the series of operations are integrated into a cartridge with a view to facilitating the replacement of coating film transfer tapes. However, replacement of many members which still function properly together with a used-up coating film transfer tape is totally a waste, and such replacement does not seem to meet the original object to conserve the resources and reduce wastes.

In addition, even among the cartridge type refilling products, there are those having a simple construction and fewer constituent members to be replaced. However, with those products, operations needed to complete the replacement often tend to become more complicated by an extent to which the number of members to be replaced is reduced.

To cope with this, techniques were devised for eliminating the drawback of the aforesaid cartridge type coating film transfer tool. For example, the invention disclosed in Japanese Unexamined Patent Publication No. 9-2724 is one of them.

As shown in FIG. 22, a transfer head 900 and a supporting arm 901 for supporting the transfer head 900 are provided integrally rotatably on a coating film transfer tool according to this invention, and as shown in FIG. 23, a refill coating film transfer tape 1001 attached to a coating film transfer tape holder 1000 can easily be attached. Namely, when coating film transfer tapes are replaced, the head 900 and the arm 901 are rotated to produce a state shown in FIG. 22, in which state the refill coating film transfer tape 1001 fixed onto the holder 1000 and a take-up reel 1002 can be attached to a coating film transfer tool main body from thereabove. After the coating film transfer tape has been attached, when the head 900 and the arm 901 are rotated counterclockwise the coating film transfer tape is automatically set to the head and is also taken up to eliminate the slack of thereof, whereby the replacement of coating film transfer tapes can easily be implemented. In many cases, the largest concern of the user with the refilling type coating film transfer tools is that he or she has to engage a refill coating film transfer tape that has replaced the used-up one with the head. However, according to the aforesaid construction, the refill coating film transfer tape can be brought into engagement with the head without any special operation being performed by the user, and furthermore, the coating film transfer tape can also be automatically adjusted to eliminate the slack thereof. It can be said from this that the superior mechanism can be provided by the invention. In general, there is a tendency that the ease with which coating film transfer tapes are replaced is in contradiction to the number of constituent members to be replaced, and trying to limit the replacement work only to the replacement of a used-up coating film transfer tape while reducing the number of constituent members to be replaced forces the user to perform cumbersome operations such as manually engaging the coating film transfer tape with the head and then adjusting the take-up real to eliminate the slack of the tape. However, according to this invention, the necessity of performing such cumbersome operation can be obviated.

Furthermore, the constituent members to be replaced are limited to the coating film transfer tape, the take-up reel, the coating film transfer tape core and the holder, and therefore, conservation of the resources is achieved remarkably largely when compared with a product in which most of the internal mechanism of the coating film transfer tool are designed to be replaced.

However, there still exists a room for improvement even with such a product, and further conservation of the resources, reduction in amount of wastes, as well as simplification of operations required for replacement of coating film transfer tapes have been demanded. For example, with the prior art product, when coating film transfer tapes are replaced there are required to be operated five steps of ① opening the main body case, ② rotating the head and the arm, ③ replacing coating film transfer tapes, ④ rotating the head and the arm to be returned to the original positions, and ⑤ closing the main body case. Although these operations are not difficult to operate once the user get used to performing them, the user is forced to feel it cumbersome to implement the operations, and hence there is a risk that a poor image may be imparted to the product.

Then, the present invention was made in view of the problem inherent in the prior art, and an object thereof is to provide a coating film transfer tool which can implement the replacement of transfer tapes with as fewer operations as possible while the simplicity and convenience provided by the prior art are being maintained.

Another object of the present invention is to provide a coating film transfer tool which can contribute to conservation of the resources and reduction in amount of wastes.

SUMMARY OF THE INVENTION

With a view to attaining the objects, according to a first aspect of the present invention, there is provided a coating film transfer tool for use to transfer a transfer layer provided on a side of a tape in a strippable state to a coating film receiving surface, characterized in that a main body case constructed in such a manner as to be divided into at least two separate case members is provided on a coating film transfer tool main body, and that one of the two case members is disposed manually rotatably relative to the other case member, the one case member comprising a head retaining body adapted to be interlocked with the operation of the one case member for rotation, a supply reel to which a coating film transfer tape is detachably attached, a take-up reel for taking up the coating film transfer tape after the tape has been used up, and a transfer mechanism for interlocking the supply reel and the take-up reel, whereby by opening the one case member by rotating it in one direction a head automatically rotates to be disengaged from the coating film transfer tape and at the same time the supply reel and the take-up reel become exposed out of the main body case so that the used-up coating film transfer tape is removed therefrom for replacement with a refill coating film transfer tape, whereas by closing the one case member by rotating it in an opposite direction the head not only rotates automatically in an opposite direction to engage with the refill coating film transfer tape so replaced but also is allowed to return to the same position as that the head took before it was moved.

According to the first aspect of the present invention, with the aforesaid construction the operations of the main body case, the head retaining body and the respective members provided in the main body case can be interlocked with each other. Namely, by opening one of the main body case members by rotating it relative to the other case member the head automatically rotates to be disengaged from the coating film transfer tape, and the supply reel and the take-up reel are exposed, so that the coating film transfer tape that has been used up can be removed therefrom for replacement with a refill coating film transfer tape. Then, by closing the one of the main body case members by rotating it in the opposite direction the head not only automatically rotates in the opposite direction to be brought into engagement with the refill coating film transfer tape so replaced but also returns to the same position as that the head took before it was rotated. According to the construction, the user can complete the replacement of the coating film transfer tapes only by opening the main body case, replacing the used-up coating film transfer tape with the refill coating film transfer tape, and closing the main body case. Thus, the necessity of the cumbersome operations which used to be manually individually implemented can be obviated, whereby the operations required for replacement of coating film transfer tapes can extremely be simplified.

According to a second aspect of the present invention, there is provided a coating film transfer tool for use to transfer a transfer layer provided on a side of a tape in a strippable state to a coating film receiving surface, characterized in that a main body case and a supporting body provided manually rotatably in the interior of the case main body are provided on a coating film transfer tool main body, the supporting body comprising a head retaining body adapted to be interlocked with the operation of the supporting body for rotation, a supply reel to which a coating film transfer tape is detachably attached, a take-up reel for taking up the coating film transfer tape after the tape has been used up, and a transfer mechanism for interlocking the supply reel and the take-up reel, whereby by drawing the supporting body from the main body case by rotating it in one direction a head automatically rotates to be disengaged from the coating film transfer tape and at the same time the supporting body moves out of the main body case so that the used-up coating film transfer tape is removed therefrom for replacement with a refill coating film transfer tape, whereas by accommodating the supporting body back in the main body case by rotating it in an opposite direction the head not only rotates automatically in an opposite direction to engage with the refill coating film transfer tape so replaced but also is allowed to return to the same position as that the head took before it was moved.

According to the second aspect of the present invention, with the aforesaid construction the operations of the supporting body, the head retaining body and the respective members provided on the supporting body can be interlocked with each other. Namely, by drawing the supporting body from the main body case by rotating it in the one direction the head automatically rotates to be disengaged from the coating film transfer tape that has been used up and at the same time the supporting body moves out of the main body case so that the used-up coating film transfer tape can be removed therefrom for replacement with the refill coating film transfer tape. On the contrary, by accommodating the supporting body back in the main body case by rotating it in the opposite direction the head not only automatically rotates in the opposite direction to be brought into engagement with the refill coating film transfer tape so replaced but also returns to the same position as that the head took before it was rotated. According to the construction, the user can complete the replacement of the coating film transfer tapes only by opening the main body case, replacing the used-up coating film transfer tape with the refill coating film transfer tape, and closing the main body case. Thus, the necessity of the cumbersome operations which used to be manually individually implemented can be obviated, whereby the operations required for replacement of coating film transfer tapes can extremely be simplified.

According to a third aspect of the present invention, there is provided a coating film transfer tool as set forth in the second aspect of the invention, wherein the head retaining body is provided with a gear adapted to mesh with a rack provided on the main body case and a ratchet adapted to interlock with the supply reel, wherein the supply reel of the supporting body, to which a coating film transfer tape is detachably attached, is provided with a gear having a center axis concentric with a rotational center axis of the supply reel and a pawl adapted to be locked in the ratchet provided on the head retaining body, wherein the take-up reel for taking up a coating film transfer tape after the tape has been used up is provided with a gear having a center axis concentric with a rotational center axis of the take-up reel, and wherein an intermediate gear is provided on the supporting body for interlocking the gears with each other which are provided on the supply reel and the take-up reel, respectively.

According to the third aspect of the present invention, with the aforesaid construction, the operations of the head retaining body, the supply reel and the take-up reel can be interlocked with each other, whereby only by opening the supporting body from the main body case by rotating it in the one direction the respective members on the supporting body can be operated in an interlocked fashion. According to this construction, when replacing coating film transfer tapes the user only has to replace the coating film transfer tape that has been used up with the refill coating film transfer tape, and hence the necessity is obviated of performing adjustment work such as moving individually the constituent members provided in the interior of the coating film transfer tool for eliminating the slack of the refill coating film transfer tape so replaced. Thus, the necessity of performing the adjustment work that used to be individually performed by the user when replacing coating film transfer tapes can be obviated, whereby the operations required for replacement of coating film transfer tapes can extremely be simplified.

According to a fourth aspect of the present invention, there is provided a coating film transfer tool as set forth in the second or third aspect of the present invention, wherein when the supporting body is rotated in one direction to be drawn out of the main body case the head automatically rotates to move into between the supply reel and the take-up reel and is automatically disengaged from the coating film transfer tape.

According to the fourth aspect of the invention, when the supporting body is drawn from the main body case by rotating it in the one direction when coating film transfer tapes are replaced interlocking with the operation of the supporting body, the head retaining body automatically rotates. As this occurs, the head not only automatically rotates to move into between the supply reel and the take-up reel but also operates to be disengaged from the coating film transfer tape. Thus, the user is not required intentionally to disengage the coating film transfer tape from the head and to move the head to a position that does not disrupt the replacement of coating film transfer tapes, whereby the user can complete the replacement of coating film transfer tapes extremely easily.

According to a fifth aspect of the present invention, there is provided a coating film transfer tool as set forth in any of the second to fourth aspects of the invention, wherein when the supporting body is rotated in the opposite direction to be accommodated back in the main body case the head automatically rotates in the opposite direction not only to engage with a refill coating film transfer tape so replaced but also to remove the slack of the coating film transfer tape.

According to the fifth aspect of the present invention, when replacing coating film transfer tapes by accommodating the supporting body back in the main body case by rotating the supporting body in the opposite direction interlocking with the operation of the supporting body, the head retaining body automatically rotates in the opposite direction. As this occurs, the head is brought into engagement with the refill coating film transfer tape so replaced, and the slack of the coating film transfer tape can be removed. Thus, the user is not required intentionally to bring the coating film transfer tape into engagement with the head and to adjust the slack of the coating film transfer tape, whereby the user can complete the replacement of the coating film transfer tapes extremely easily.

According to a sixth aspect of the present invention, there is provided a coating film transfer tool as set forth in any of the second to fifth aspects of the invention, wherein a rotating wall adapted to rotate relative to the main body case is provided on the main body case positioned on a rotating locus of the supporting body and wherein a biasing mechanism is provided on the rotating wall for automatically returning the rotating wall from a rotated position to the position the rotating wall took before it was rotated.

According to the sixth aspect of the present invention, when the supporting body is rotated in the one direction to replace coating film transfer tapes the head or the part of the supporting body comes into contact with the rotating wall, and as this occurs, the rotating wall is moved without disrupting the operation of the supporting body. Then, when the supporting body is rotated in the opposite direction after the replacement of the coating film transfer tapes has been completed the rotating wall also comes into contact with the supporting body and is moved without disrupting the operation of the supporting body. As this series of operations occurs, since the biasing mechanism is provided on the rotating wall, a force is always applied to the rotating wall in a direction in which the rotating wall is returned to its original position, whereby the rotating wall is prevented from being left in an opened state.

According to a seventh aspect of the present invention, there is provided a method for replacing coating film transfer tapes for use in a coating film transfer tool for use to transfer a transfer layer provided on a side of a tape in a strippable state to a coating film receiving surface, characterized in that a main body case and a supporting body provided manually rotatably in the interior of the case main body are provided on a coating film transfer tool main body, the supporting body comprising a head retaining body adapted to be interlocked with the operation of the supporting body for rotation, a supply reel to which a coating film transfer tape is detachably attached, a take-up reel for taking up the coating film transfer tape after the tape has been used up, and a transfer mechanism for interlocking the supply reel and the take-up reel, whereby by drawing the supporting body from the main body case by rotating it in one direction a head automatically rotates to be disengaged from the coating film transfer tape and at the same time the supporting body moves out of the main body case so that the used-up coating film transfer tape is replaced with a refill coating film transfer tape, whereas by accommodating the supporting body back in the main body case by rotating it in an opposite direction the head not only rotates automatically in an opposite direction to engage with the refill coating film transfer tape so replaced but also is allowed to return to the same position as that the head took before it was moved, the method comprising the operations of rotating the supporting body in one direction to draw it from the main body case so as to remove a coating film transfer tape that has been used up, attaching a refill coating film transfer tape to the supply reel and the take-up reel after the used-up coating film transfer tape has been removed, and rotating the supporting body in the opposite direction to return the supporting body back into the main body case.

According to the seventh aspect of the present invention, with the aforesaid construction the replacement of the coating film transfer tapes can be facilitated. Namely, the user can complete the replacement of the coating film transfer tapes only by performing operations of rotating the supporting body in the one direction so as to draw it from the main body case for removal of the coating film transfer tape that has been used up, attaching the refill coating film transfer tape to the supply reel and the take-up reel after the used-up coating film transfer tape has been removed, and rotating the supporting body in the opposite direction so as to accommodate the supporting body back in the main body case.

According to the construction of a coating film transfer tool of the present invention, a main body case constructed to be divided into at least two separate case members is provided on a main body of the coating film transfer tool, and one of the case members is disposed manually rotatably relative to the other main body case member. Then, provided on the one case member are a head retaining body adapted to be interlocked with the operation of the one case member for rotation, a supply reel to which a coating film transfer tape is detachably attached, a take-up reel for taking up the coating film transfer tape after the tape has been used up, and a transfer mechanism for interlocking the supply reel and the take-up reel. According to the construction, by opening the one case member by rotating it in one direction a head automatically rotates to be disengaged from the coating film transfer tape and at the same time the supply reel and the take-up reel become exposed so that the used-up coating film transfer tape is removed therefrom for replacement with a refill coating film transfer tape. On the contrary, by closing the one case member by rotating it in an opposite direction the head not only rotates automatically in an opposite direction to engage with the refill coating film transfer tape so replaced but also is allowed to return to the same position as that the head took before it was moved.

In addition, according to the construction of another coating film transfer tool of the present invention, a coating film transfer tool comprises a main body case and a supporting body provided manually rotatably in the interior of the main body case. Then, provided on the supporting body are a head retaining body adapted to be interlocked with the operation of the supporting body for rotation, a supply reel to which a coating film transfer tape is detachably attached, a take-up reel for taking up the coating film transfer tape after the tape has been used up, and a transfer mechanism for interlocking the supply reel and the take-up reel. According to the construction, by drawing the supporting body from the main body case by rotating it in one direction a head automatically rotates to be disengaged from the coating film transfer tape and at the same time the supporting body moves out of the main body case so that the used-up coating film transfer tape is removed therefrom for replacement with a refill coating film transfer tape. On the contrary, by accommodating the supporting body back in the main body case by rotating it in an opposite direction the head not only rotates automatically in an opposite direction to engage with the refill coating film transfer tape so replaced but also is allowed to return to the same position as that the head took before it was moved.

Thus, according to the aforesaid constructions of the present invention, it is possible to provide the coating film transfer tools which can implement the replacement of coating film transfer tapes with as few operations as possible while the simplicity and convenience are being maintained. Furthermore, since constituent members to be replaced are limited to those such as the coating film transfer tape, the core of the coating film transfer tape and the tape locking body, it is possible to provide the coating film transfer tools that can contribute to conservation of the resources, as well as reduction in amount of wastes.

BRIEF DESCRIPTION OF THE DRAWINGS

The invention will be better understood from reading the description which will follow, which is given merely by way of example and made with reference to the appended drawings, in which.

DETAILED DESCRIPTION OF THE INVENTION

An embodiment according to the present invention will be described in detail below with reference to the appended drawings.

Figure 1:
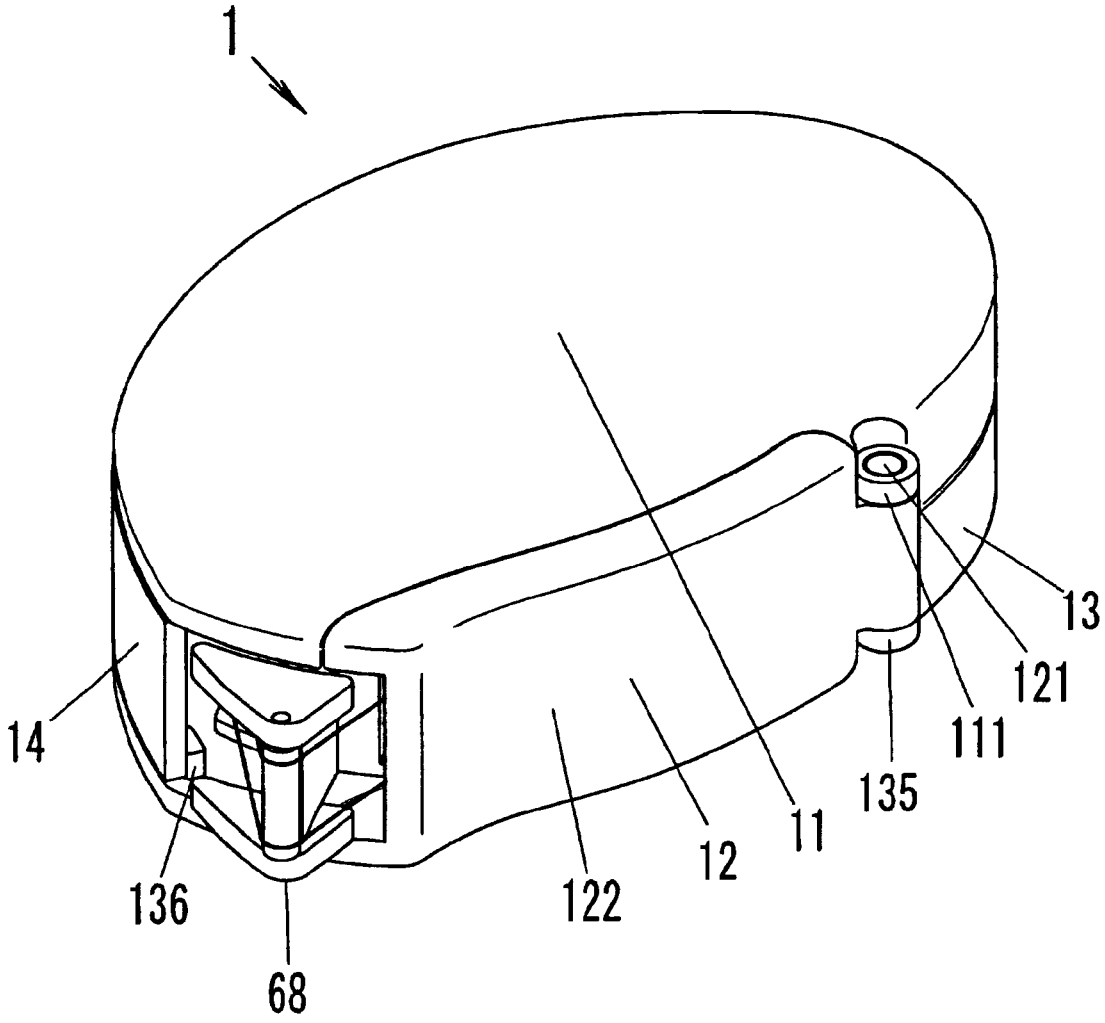
FIG. 1 is a view showing an external appearance of one embodiment according to the present invention.

FIG. 1 shows an external appearance of an embodiment according to the present invention.

A main body 1 of a coating film transfer tool according to the present invention comprises an upper case 11, a lower case 13 and a supporting body (an intermediate case) 12. The respective cases are formed from resin material. Then, a main mechanism in the interior of the main body is provided on the supporting body 12. The supporting body 12 is constructed to freely rotate on a shaft 121 which is rotatably supported at supporting portions 111, 135 provided on the upper case 11 and the lower case 13, respectively, and can be opened with ease when the user replaces coating film transfer tapes. A rotating wall 14 is brought into contact with part of a head 68 or the supporting body 12 when the supporting body 12 is opened, and as this occurs, the rotating wall 14 rotates so that the movement of the supporting body 12 is not disrupted.

Figure 2:
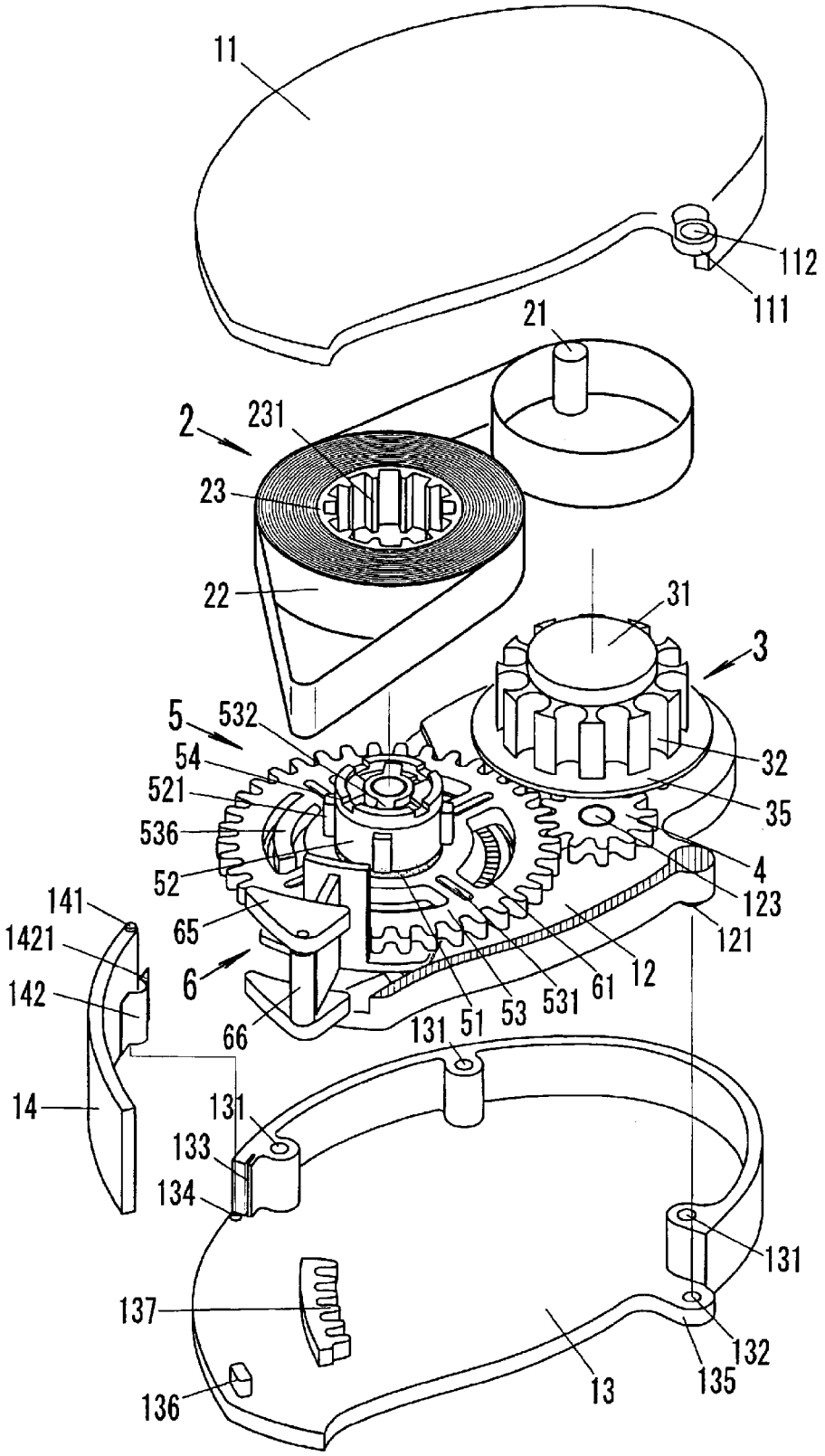
FIG. 2 is an exploded perspective view showing the internal construction of a coating film transfer tool shown in FIG. 1.

FIG. 2 is an exploded perspective view showing the internal construction of the main body of the coating film transfer tool shown in FIG. 1. Note that the figure is shown with a side wall 122 of the supporting body 12 being cut away as a matter of convenience.

Figure 3:
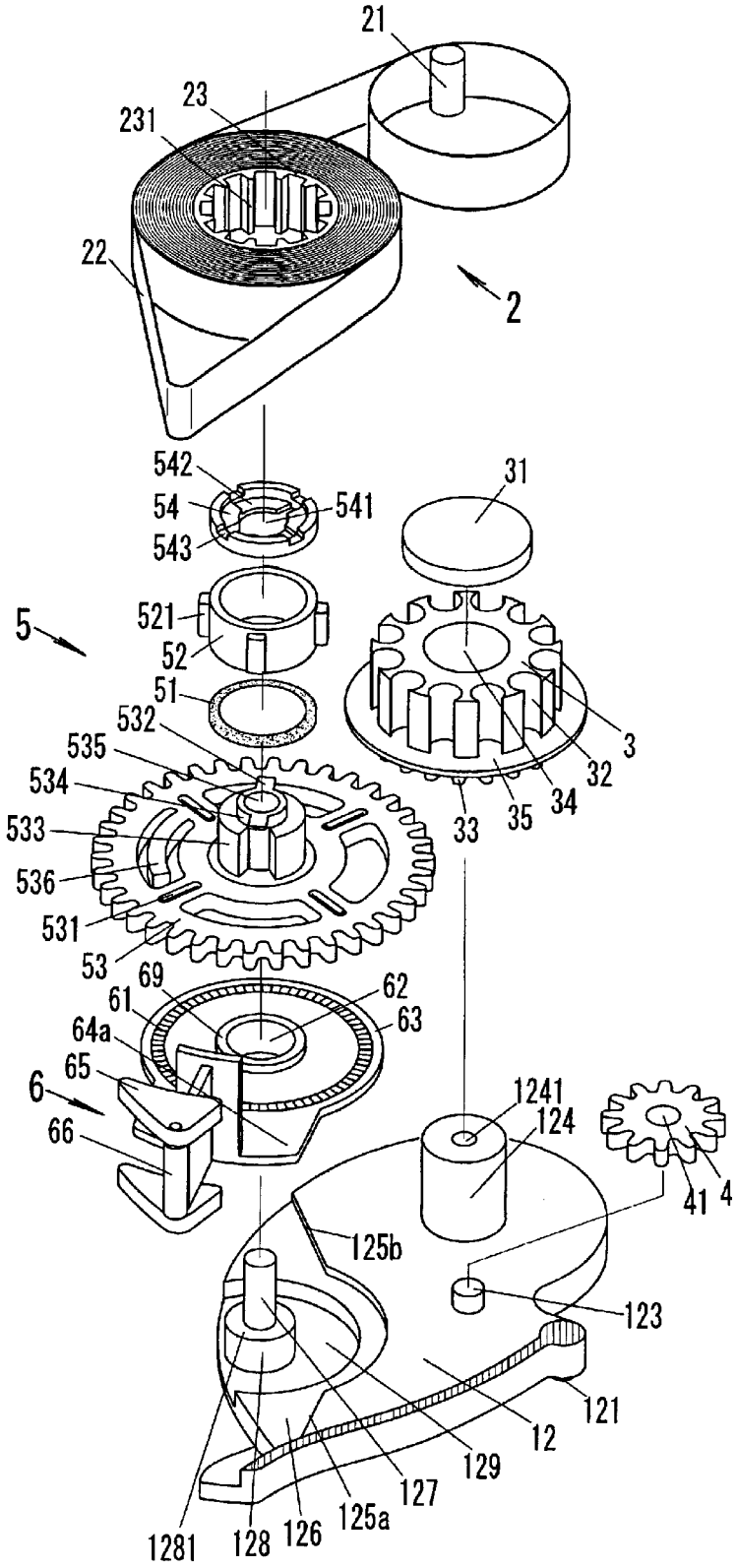
FIG. 3 is an exploded perspective view showing the constructions of members provided on a supporting body shown in FIG. 2.

FIG. 3 is an exploded perspective view showing the constructions of respective constituent members disposed on the supporting body shown in FIG. 2.

The upper case 11 and the lower case 13 of the main body 1 are constructed to be assembled together by allowing projections (not shown) provided on the upper case 11 to fit in holes 131 formed in the lower case 13. Note that the projections on the upper case side are provided at positions which correspond to the holes 131 formed in the lower case 13 and the projections are so sized that they tightly fit in the holes 131.

The rotating wall 14 is formed such that a shaft 141 is provided at both edges of one end thereof and is mounted in such a manner as to freely rotate with the shafts 141 being rotatably supported in a hole (not shown) in the upper case 11 and a hole 134 formed in the lower case 13. In addition, a plate spring 142 acting as a biasing means is mounted on the rotating wall 14, and when it is assembled, an end portion 1421 of the plate spring 142 is inserted into a locking groove 133 formed in the lower case so as to be locked therein. Since the rotating wall 14 is biased in a counter-clockwise direction with this plate spring 142, the rotating wall can be closed automatically. Furthermore, an abutment portion 136 is provided in the interior of the lower case 13, whereby a movable range is regulated over which the rotating wall 14 biased with the plate spring 142 can be moved. Note that while in the embodiment the resin plate spring 142 is described as functioning as the biasing means, any other member than the plate spring may be used provided that such a member functions equally to the plate spring. For example, a member that can perform a function equal to that of the plate spring may be formed integrally on the end portion of the rotating wall 14, or a biasing mechanism may be provided which makes use of the restoring force of a coil spring.

The supporting body 12 is constructed to freely rotate on the shaft 121 provided on the end thereof which is rotatably supported in the holes 112 and 132 formed in the supporting portions 111 and 135, respectively. Then, a supply reel 5, a head retaining body 6, an intermediate gear 4 and a take-up reel 3 are provided on the supporting body 12.

Figure 4:
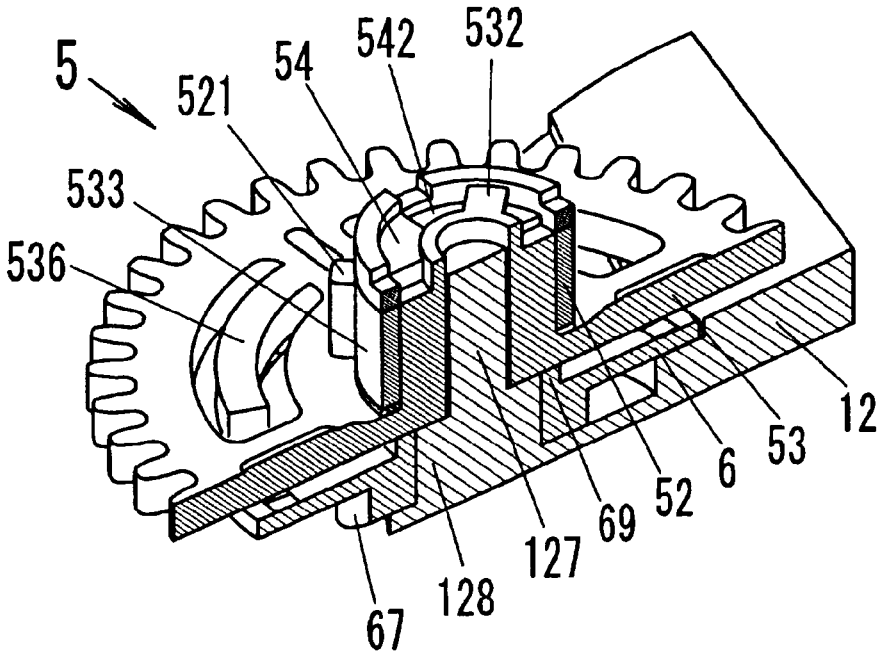
FIG. 4 is a partial cross-sectional view showing the construction of a portion in the vicinity of a supply reel of the supporting body.
Figure 5:
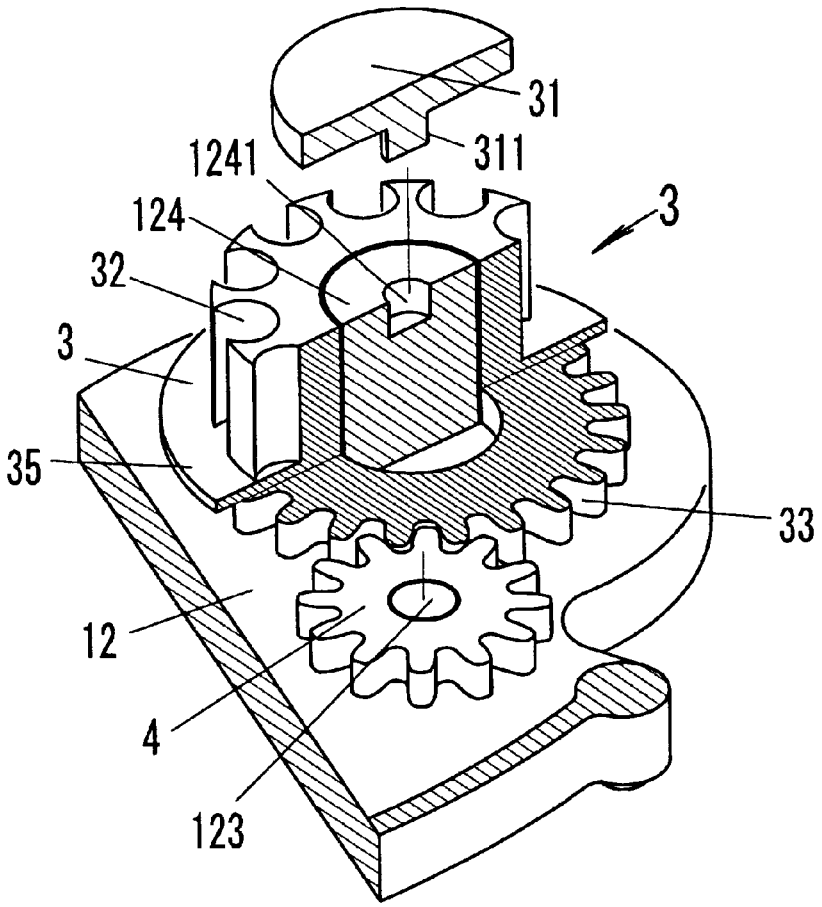
FIG. 5 is a partial cross-sectional view showing the construction of a portion in the vicinity of a take-up reel of the supporting body.
Figure 6:
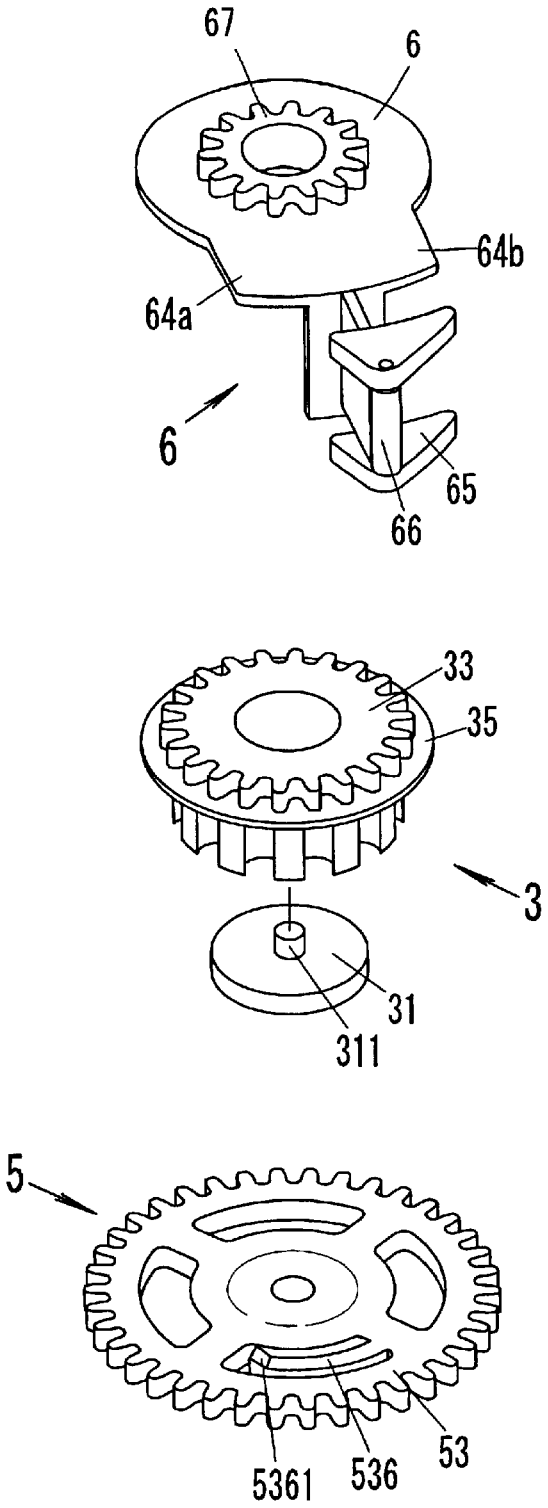
FIG. 6 is perspective views of a head retaining body 6, the take-up reel 3, and the supply reel 5 as viewed from below, respectively.

In description of the positional relationship of the respective members when they are mounted on the supporting body, since FIGS. 2 and 3 are not good enough for clear description of the details of the respective members, FIGS. 4 to 6 will also be referred to in the description.

FIG. 4 is a partial cross-sectional view showing the construction of a portion in the vicinity of the supply reel of the supporting body.

FIG. 5 is a partial cross-sectional view showing the construction of a portion in the vicinity of the take-up reel of the supporting body.

FIG. 6 shows perspective views of the members whose configurations cannot be clarified in FIGS. 2 and 3, the members being viewed upside down.

The supply reel 5 is constituted by a retaining cap 54, a cylindrical body 52, a frictional body 51 and a gear member 53. The retaining cap 54, the cylindrical body 52 and the gear member 53 are formed through resin molding, respectively, and the frictional body 51 is formed by working felt into a ring-like configuration. In addition, four recessed portions are formed in an upper portion of the retaining cap 54, and the retaining cap 54 can be rotated easily using a tool that fits in these recessed portions. Then, to describe the positional relationship of the respective members when they are mounted, firstly, the frictional body 51 is loosely placed on a thick shaft portion 533 of the gear member 53, and the cylindrical body 52 is loosely placed on the frictional body 51 from there above. Then, the retaining cap 54 is loosely placed on a thin shaft portion 534 of the gear member 53 and is rotated clockwise, whereby the assembly of the supply reel 5 is completed. Then, a state is produced in the retaining cap 54 in which a pair of locking pawls 532 provided on the thin shaft portion 534 of the gear member 53 is locked on upper surfaces 542 of stepped portions formed on circumferential portions of a hole 541. Then, as this occurs, the frictional body 51 is sandwiched between a bottom surface of the cylindrical body 52 and an upper surface of he gear member 53 to there by constitute a frictional clutch. Namely, since a sum of the thickness of the frictional body 51 and the height of the cylindrical body 52 is constructed to be slightly greater than the height of the thick shaft portion 533, the frictional body 51 is compressed in a vertical direction, and a certain load is produced by friction produced at a contact surface between the cylindrical body 52 and the frictional body 51 when the cylindrical body 52 rotates. In using the coating film transfer tool, the core 23 of the coating film transfer tape is fitted on the cylindrical body 52 for rotation together with the cylindrical body 52. As this occurs, the coating film transfer tape is adjusted by the frictional clutch mechanism such that an amount of the coating film transfer tape supplied by the supply reel becomes equal to an amount of the same transfer tape taken up by the take-up reel. Namely, the amount of the transfer tape to be taken up by the take-up reel is made larger than the amount of the transfer tape to be supplied by the supply reel, and an exceeding portion of the taken-up amount by the take-up reel is constructed to be absorbed through slippage of the frictional clutch portion. According to this construction, the coating film transfer tape is prevented from slacking or snapping off and can be fed stably with a certain magnitude of tension being maintained.

In addition, a head 68 comprising a guide flange 65 and a roller 66, a ratchet 61 and a gear member 67 are provided on the head retaining body 6 positioned below a lower portion of the supply reel 5. This ratchet 61 engages with a locking pawl 5361 formed on an end portion of an arm 536 provided on the gear member 53 of the supply reel to regulate the rotating direction of the supply reel. To be specific, the supply reel is allowed to rotate freely in a clockwise direction but is prevented from rotating in a counterclockwise direction, whereby since the movable direction of the coating film transfer tape is restricted to one direction, the coating film transfer tape is prevented from being pulled out in a wrong direction when in use.

The supply reel 5 and the head retaining body 6 are constructed as has just been described above, and the positional relationship between them when they are mounted will be as below.

First of all, the head retaining body 6 is loosely placed on a thick shaft 128 formed on the supporting body 12 at a hole 62 formed in a center of the head retaining body 6, whereby the head retaining body 6 becomes rotatable. In this state, a rim 63 of the head retaining body 6 is guided into a first recessed portion 126 formed in the supporting body 12, and the gear member 67 provided at a lower portion of the head retaining body 6 is guided into a second recessed portion 129 formed in the supporting body 12. Then, an edge portion 69 of the head retaining body 6 is positioned as high as an upper surface 1281 of the thick shaft portion 128 provided on the supporting body 12.

Next, the supply reel 5 is loosely placed on a thin shaft 127 provided on the supporting body 12 at a hole 535 thereof. Then, the supply reel 5 is placed on the upper surface 1281 of the thick shaft portion 128 and the edge portion 69 of the head retaining body 6, whereby the supply reel 5 becomes rotatable. In addition, as this occurs, the locking pawl 5361 formed at the end portion of the arm 536 provided on the gear member 53 of the supply reel 5 is locked in the ratchet 61 provided on the head retaining body 6.

Next, the intermediate gear 4 is loosely placed on a shaft 123 provided on the supporting body 12 to thereby be mounted thereon. Since a hole 41 formed in the intermediate gear 4 is sized slightly larger than the outside diameter of the shaft 123, the intermediate gear 4 becomes rotatable relative to the shaft 123. In addition, as this occurs, the intermediate gear 4 meshes with the gear member 53 of the supply reel 5.

Next, the take-up reel 3 is loosely placed on a shaft 124 provided on the supporting body 12, and then a retaining cap 31 having a projection 311 formed on a lower surface thereof is mounted on the take-up reel 3 from thereabove, whereby the take-up reel 3 is fixed. The projection 311 formed on the lower surface of the retaining cap 31 tightly fits in a hole 1241 formed in the shaft 124. As this occurs, since the shaft 124 is formed higher than the take-up reel 3 and a hole 34 formed in the take-up reel 3 is made slightly larger than the outside diameter of the shaft 124, the take-up reel 3 becomes rotatable relative to the shaft 124. Then, a gear portion 33 formed on the lower portion of the take-up reel 3 is brought into mesh engagement with the intermediate gear 4. In addition, a rim 35 of the take-up reel 3 is located at a position which is slightly spaced away from the upper portion of the gear member 53 of the supply reel 5, whereby vertical movements of the gear member 53 are restricted, so that the supply reel 5 is prevented from being dislocated from the shaft.

Then, a tape unit 2 is mounted on the reels when in use. In this tape unit 2, a coating film transfer tape 22 is wound around the tape core 23 in the interior of which a plurality of slipping preventing pawls 231 are formed, and a round shaft-like tape locking body 21 is attached to one end of the coating film transfer tape. When the tape unit is mounted on the reels the core 23 around which the coating film transfer tape 22 is wound is mounted on the supply reel 5, whereas the tape locking body 21 is mounted in one of slits 32 formed in the take-up reel 3. As this occurs, a plurality of locking pawls 521 provided on the outer circumferential surface of the cylindrical body 52 provided on the supply reel 5 are brought into contact with the slipping preventing pawls 231 formed on the tape core 23, whereby the tape unit 2 is allowed to rotate together with the cylindrical body 52. Then, the coating film transfer tape mounted on the cylindrical body 52 is brought into contact with raised portions 531 formed on an upper surface of the gear member 53, whereby an unnecessary rotational load is prevented from being applied to the coating film transfer tape when the frictional clutch is actuated.

When the supporting body 12, which is assembled as has just been described above, is mounted on the lower case 13 the gear portion 67 provided on the head retaining body 6 meshes with a rack 137 provided on the lower case 13, whereby the rack 137, the head retaining body 6, the supply reel 5, the intermediate gear 4 and the take-up reel 3 are allowed to operate in connection with each other.

Note that the details of the tape unit 2 will be described later with reference to FIGS. 11 to 13.

The coating film transfer tool according to the present invention is constructed as has been described heretofore, and the operation thereof will be described below.

FIGS. 7 to 10 show a process of a connected operation between the supporting body 12 and the head retaining body 6. Each figure shows only members which are necessary for description, and other members are omitted or only external configurations thereof are shown. In addition, for the sake of clarification of the operation of the internal mechanism the main body case is shown in cross section.

Figure 7:
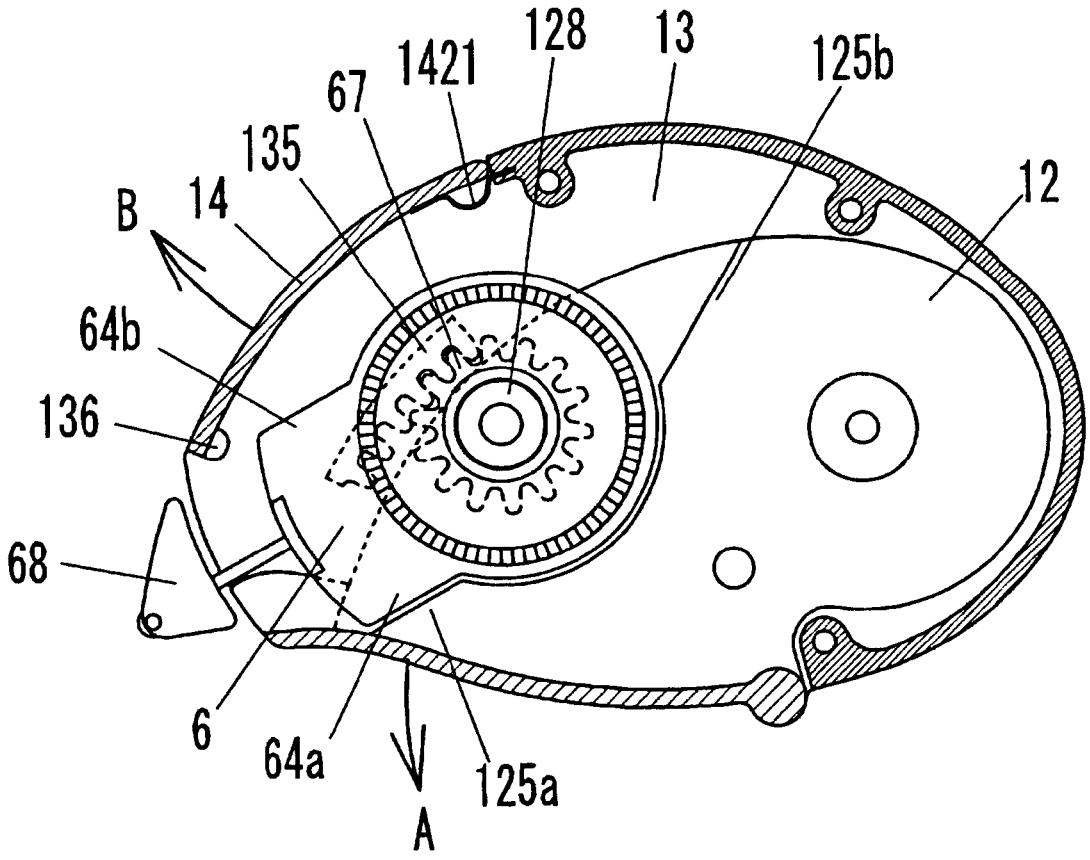
FIG. 7 is an explanatory view explaining the operations of the supporting body and the head retaining body.
Figure 8:
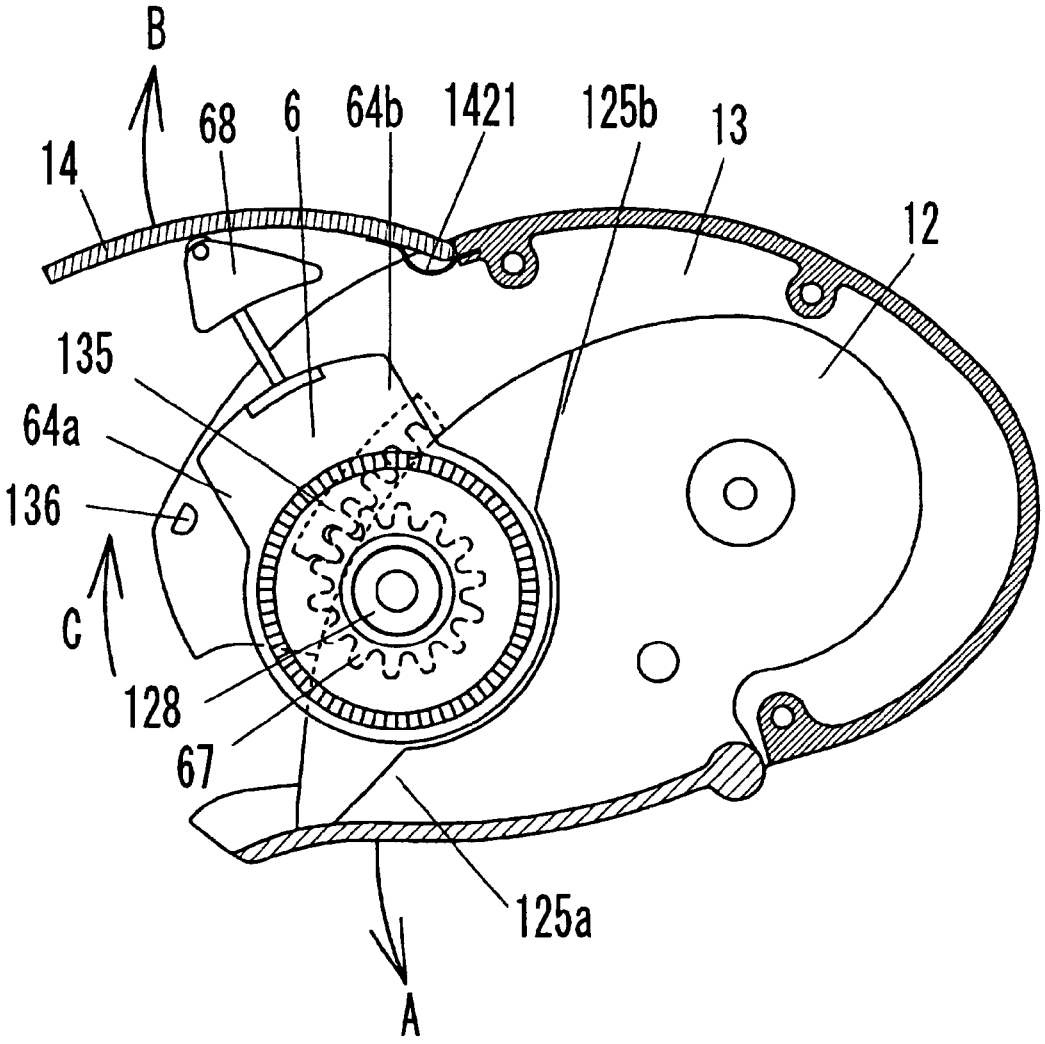
FIG. 8 is an explanatory view explaining the operations of the supporting body and the head retaining body.
Figure 9:
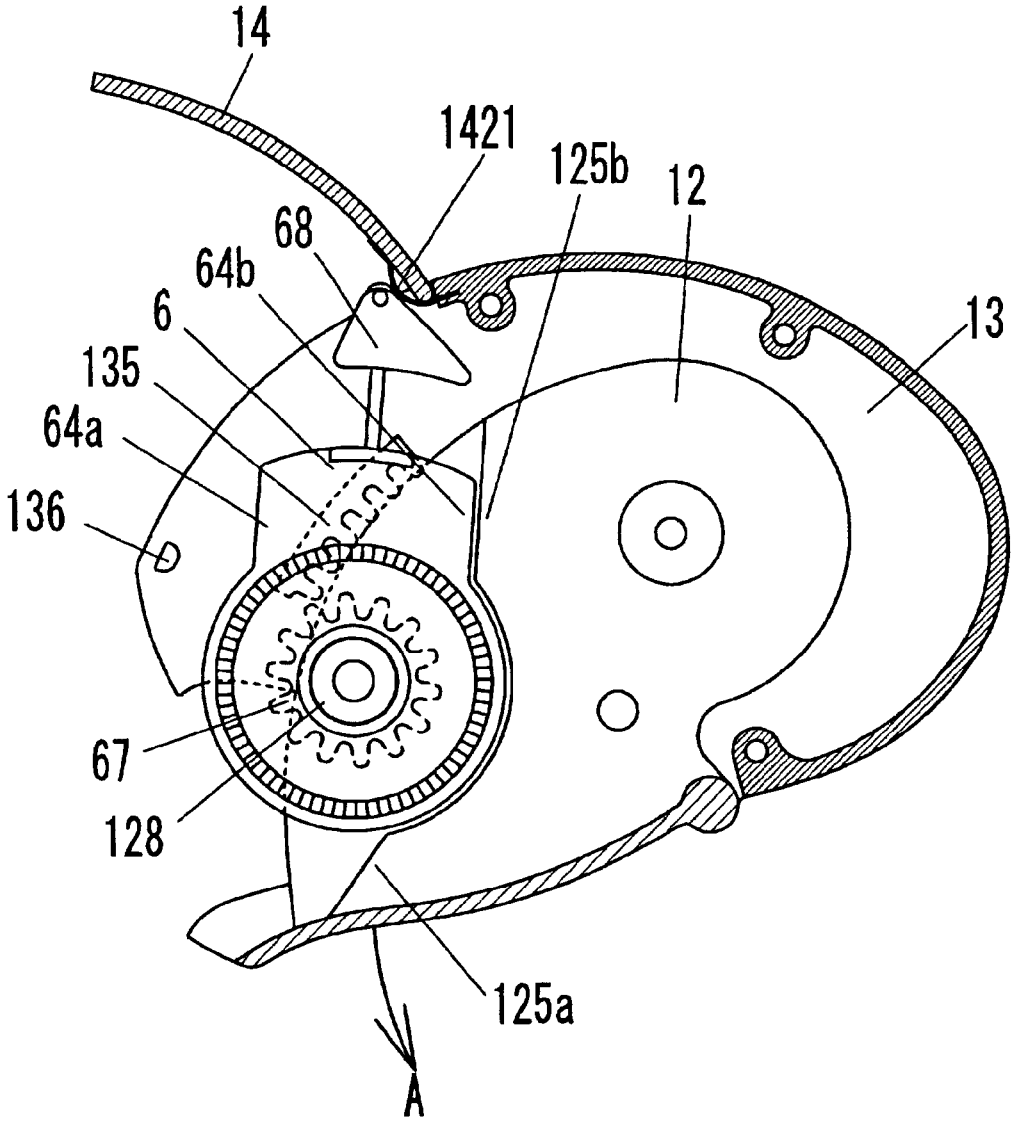
FIG. 9 is an explanatory view explaining the operations of the supporting body and the head retaining body.
Figure 10:
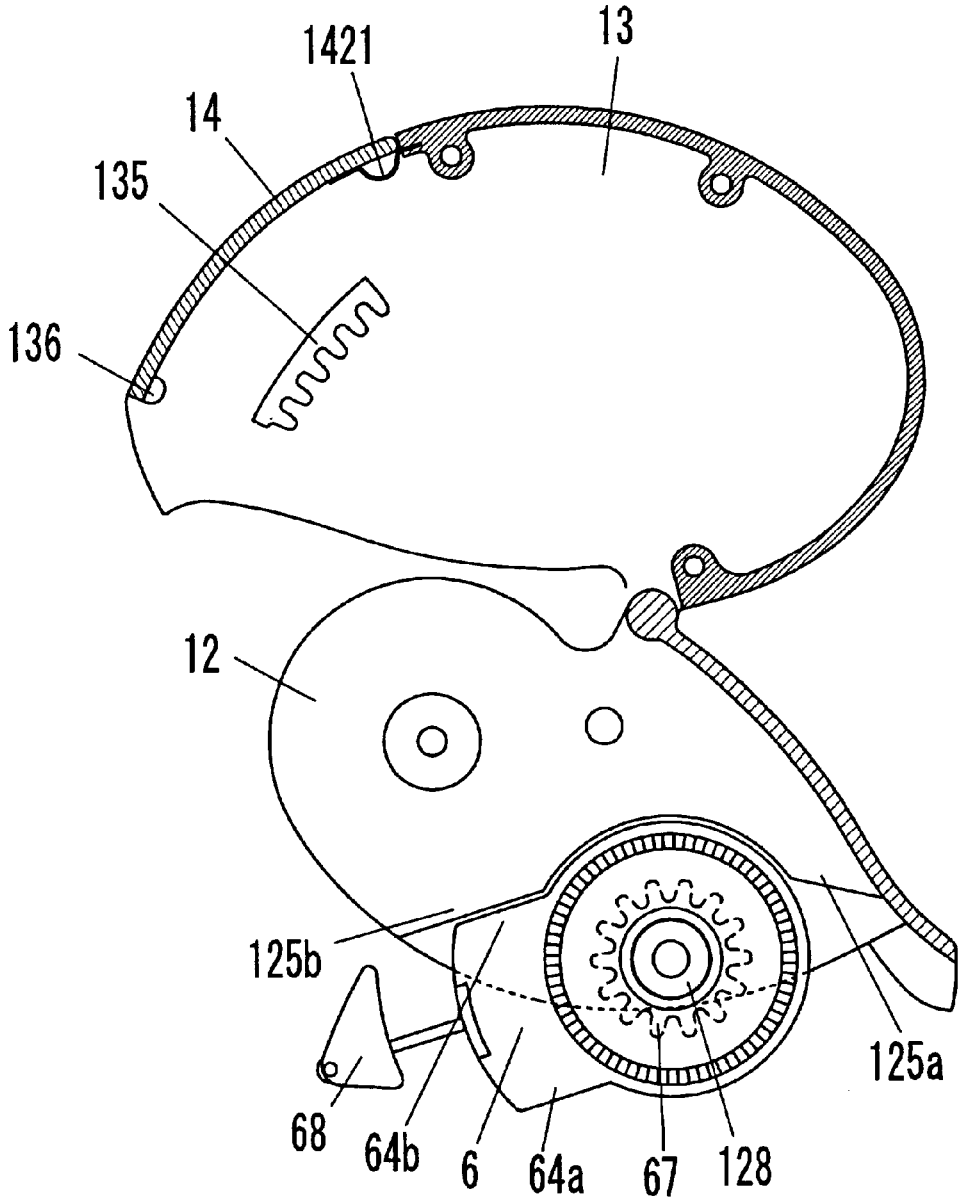
FIG. 10 is an explanatory view explaining the operations of the supporting body and the head retaining body.

FIG. 7 shows a state in which the supporting body 12 is closed and a left-hand side portion 64*a* of the head retaining body 6 is in contact with a stepped portion 125*a* on the supporting body 12. In this state, the supporting body 12 is rotated in a direction indicated by an arrow A. Then, since the gear member 67 provided on the lower portion of the head retaining body 6 is in mesh engagement with the rack 135 provided on the supporting body 12, the head retaining body 6 rotates in a direction indicated by an arrow C as shown in FIG. 8. As this occurs, part of the head retaining body 6 comes into contact with the rotating wall 14 and rotates the rotating wall 14 in a direction indicated by an arrow B. Furthermore, when the supporting body proceeds to rotate the gear member 67 provided on the lower portion of the head retaining body 6 is disengaged from the rack 135 provided on the supporting body 12. As this occurs, a right-hand side portion 64*b* of the head retaining body comes into contact with a stepped portion 125*b* on the supporting body 12. Then, when the supporting body proceeds to rotate further the supporting body 12 is drawn out of the main body case, as shown in FIG. 10. This is the operation of the head retaining body 6 in the process of drawing the supporting body 12 from the main body case, and the operation of the head retaining body 6 is reversed in a process of accommodating the supporting body 12 back into the main body case. Namely, the head retaining body 6 rotates counterclockwise, and the left-hand side portion 64*a* of the head retaining body comes into contact with the stepped portion 125*a* of the supporting body 12 at a stage in which the supporting body 12 is completely accommodated in the main body case, whereby the operation of the head retaining body 6 is completed and the state shown in FIG. 7 is restored.

On the premise of the series of operations that has just been described above, mounting of the coating film transfer tape according to the embodiment will be described.

Note that the construction of the coating film transfer tape used in this embodiment will be as follows.

Figure 11:
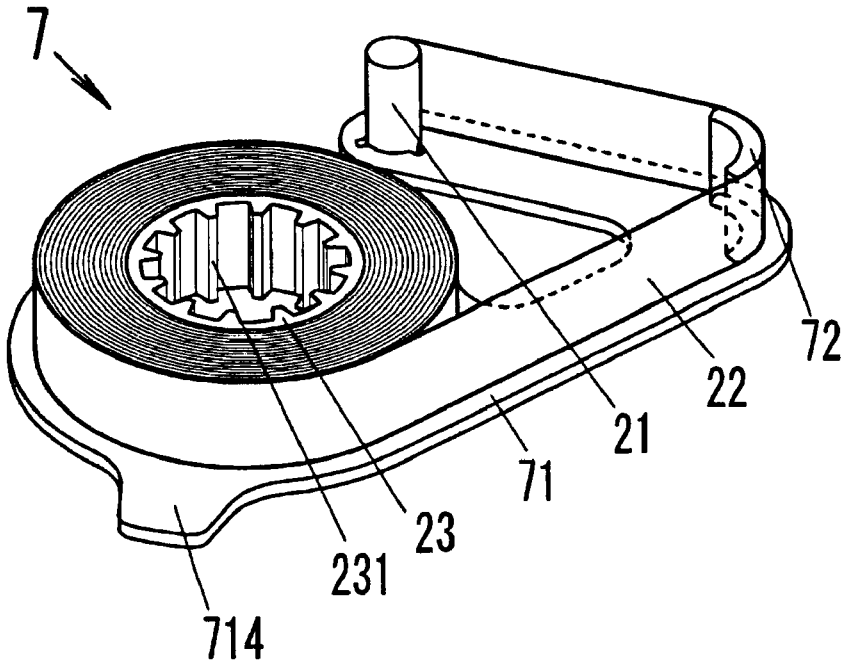
FIG. 11 is a view showing the construction of a refill coating film transfer tape.
Figure 12:
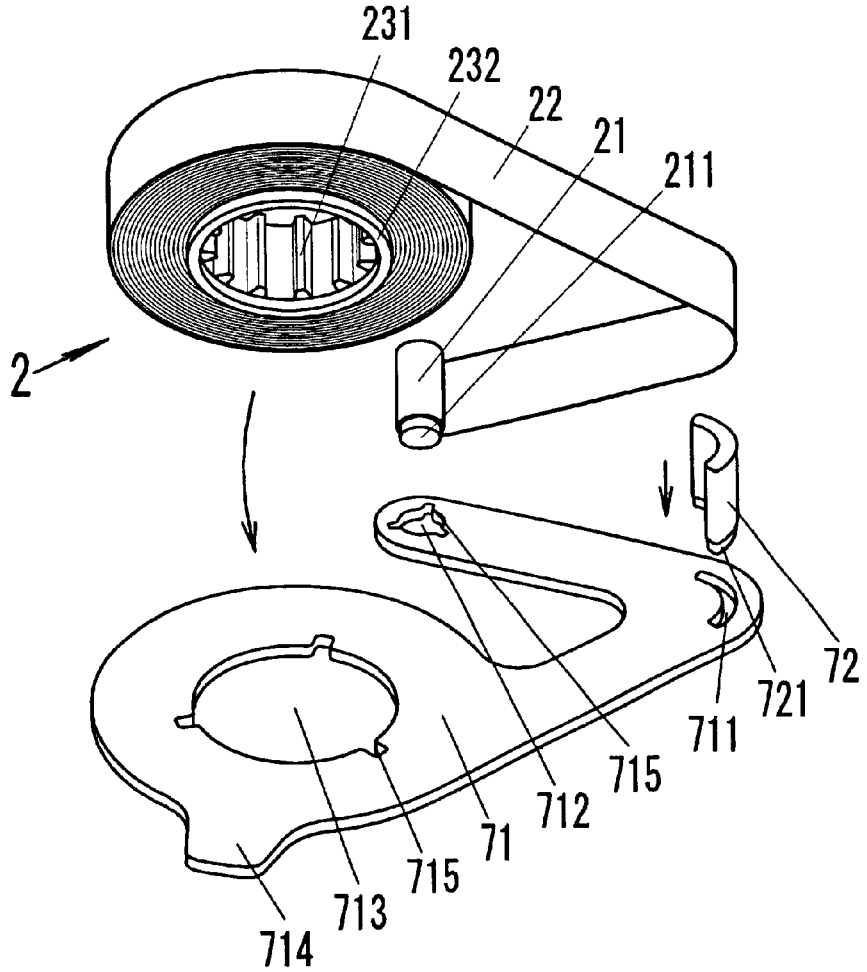
FIG. 12 is an exploded perspective view showing the construction of the refill coating film transfer tape shown in FIG. 11.
Figure 13:
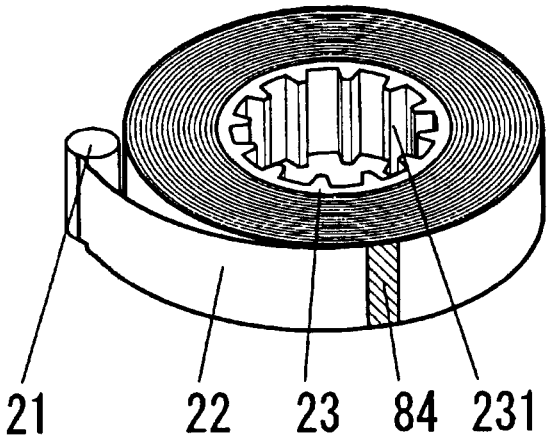
FIG. 13 is a view showing the construction of another refill coating film transfer tape.
Figure 14:
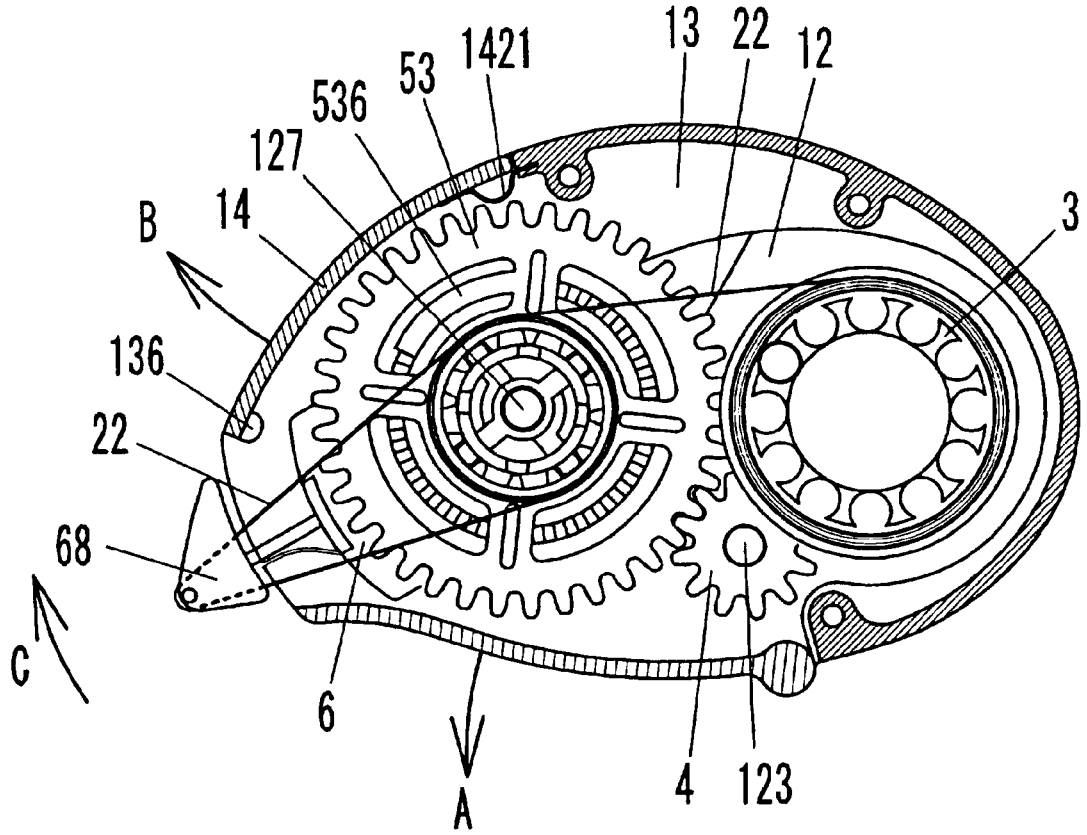
FIG. 14 is a view showing the operations of the respective members when replacing coating film transfer tapes.
Figure 15:
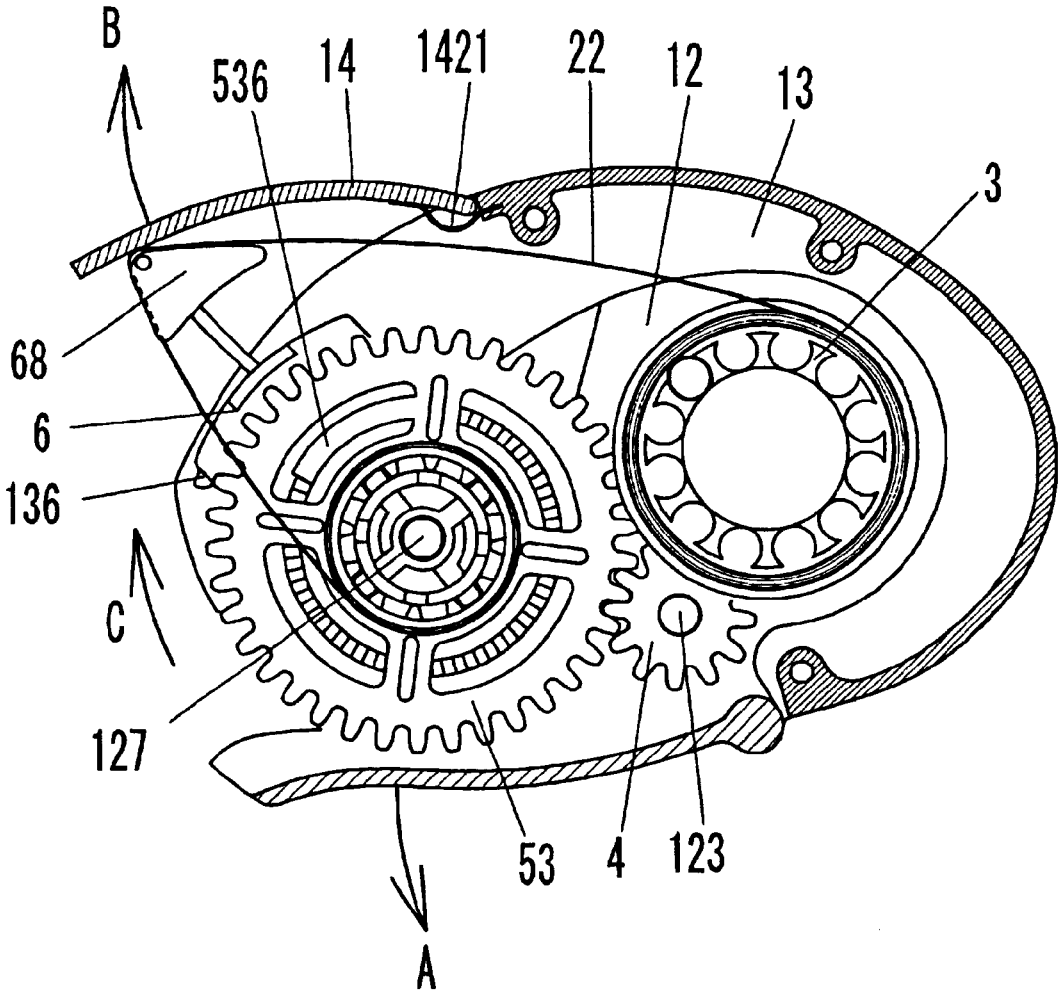
FIG. 15 is a view showing the operations of the respective members when replacing coating film transfer tapes.

FIGS. 11 to 13 show one embodiment of a refill coating film transfer tape for use in the embodiment. FIGS. 11 and 12 show the construction of a refill coating film transfer tape of a holder type, and FIG. 13 shows the construction of a refill coating film transfer tape of another type.

Firstly, referring to FIGS. 11 and 12, the embodiment of the holder type refill coating film transfer tape will be described. A refill coating film transfer tape 7 according to the embodiment is constituted by a tape unit 2 and a base board 71. In the tape unit 2, a coating film transfer tape 22 is wound around a tape core 23 in the interior of which a plurality of slipping preventing pawls 231 are formed, and a round shaft-like tape locking body 21 is attached to one end of the coating film transfer tape. In addition, locking portions 232 and 211 are formed on lower portions of the tape core 23 and the tape locking body 21, respectively, and these locking portions are adapted to fit in mounting portions formed in the base board 71. The base board 71 is a resin plate-like member, and formed therein are a reel mounting portion 713, a tape locking body mounting portion 712 and a guide mounting portion 711. In addition, pluralities of notched portions 715 are formed in the circumferential edge portions of the reel mounting portion 713 and the tape locking body mounting portion 712 so as to facilitate the deformation of the respective mounting portions, whereby the respective members that are to be mounted on the base board 71 can be mounted on and/or dismounted from the base board 71 with ease. In addition, a mounting portion 721 provided on a lower portion of a guide member 72 fits in the guide mounting portion 711 so as to be mounted therein, and the coating film transfer tape is guided by means of this guide member 72.

The construction of a coating film transfer tape shown in FIG. 13 is basically common to that of the aforesaid holder type coating film transfer tape except that a base board is not used therein. In a tape unit 2, a coating film transfer tape 22 is wound around a tape core 23 in the interior of which a plurality of slipping preventing pawls 231 are formed, and a round shaft-like tape locking body 21 is attached to one end of the coating film transfer tape. Then, part of the coating film transfer tape is adhered to another part thereof with a strippable adhesive material 84 for fixation thereto in such a manner that the tape is not unwound.

Thus, what has been described heretofore is the constructions of the refill coating film transfer tapes used in the embodiment, and referring to FIGS. 14 to 20, the replacement of coating film transfer tapes will be described.

FIGS. 14 to 20 show operations of the respective members in a process of replacing coating film transfer tapes.

Figure 16:
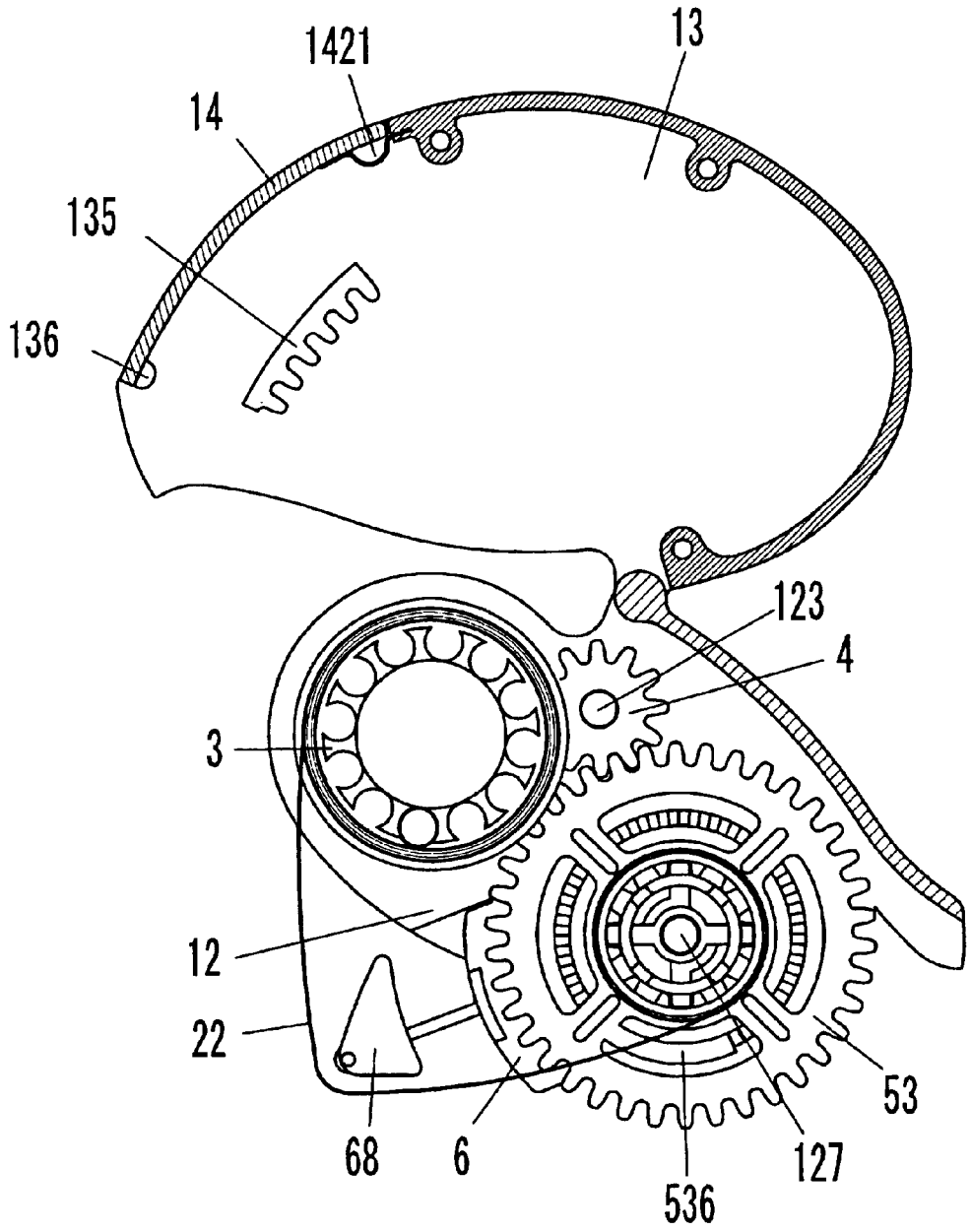
FIG. 16 is a view showing the operations of the respective members when replacing coating film transfer tapes.

When the supporting body 12 is rotated in a direction indicated by an arrow A the head retaining body 6 rotates in a direction indicated by an arrow C. As this occurs, when the head retaining body 6 comes into contact with the rotating wall 14 the rotating wall 14 rotates in a direction indicated by an arrow B. When the supporting body 12 proceeds to rotate a state shown in FIG. 16 is reached via a state shown in FIG. 15. The state shown in FIG. 16 corresponds to the state shown in FIG. 10.

Figure 17:
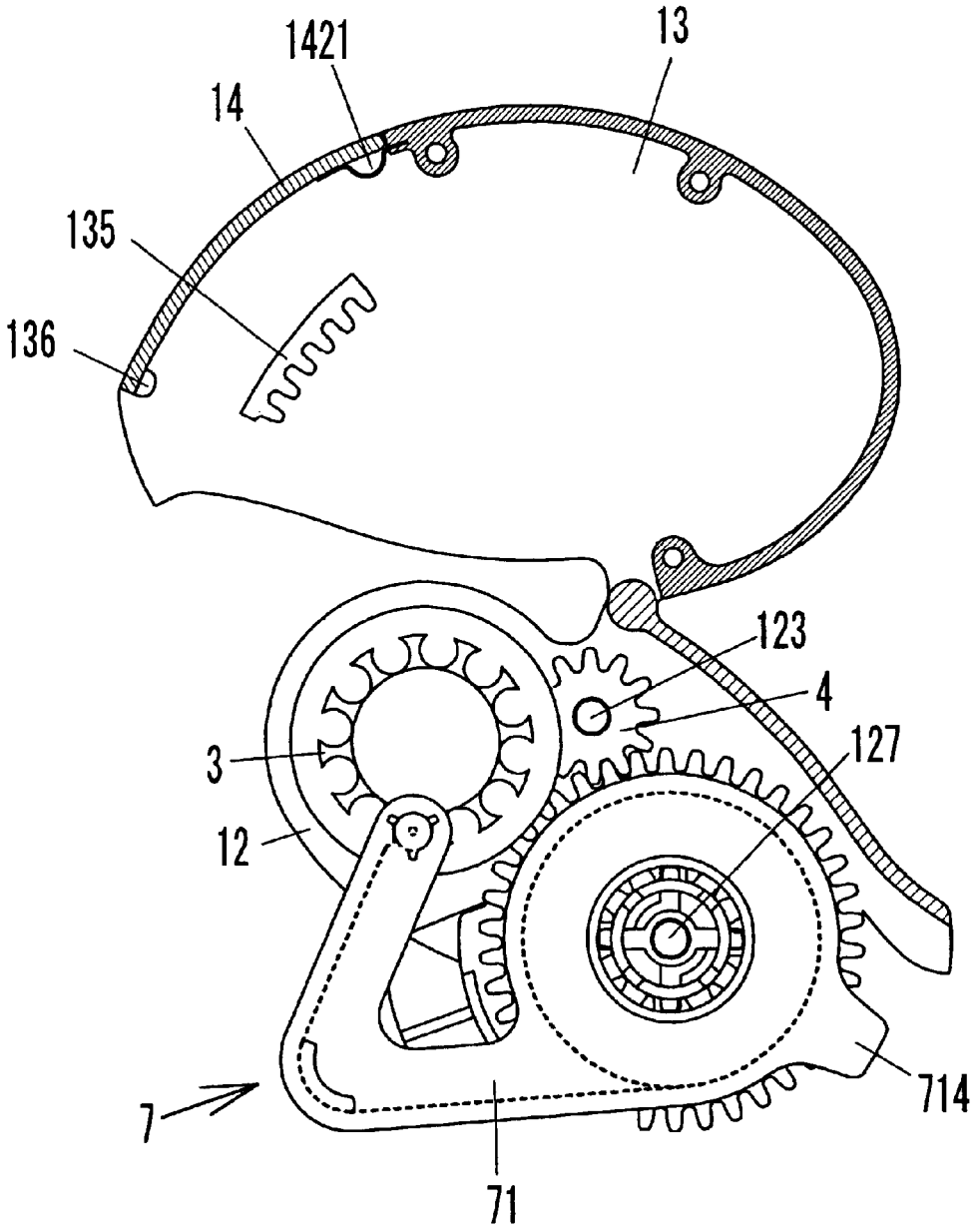
FIG. 17 is a view showing the operations of the respective members when replacing coating film transfer tapes.
Figure 18:
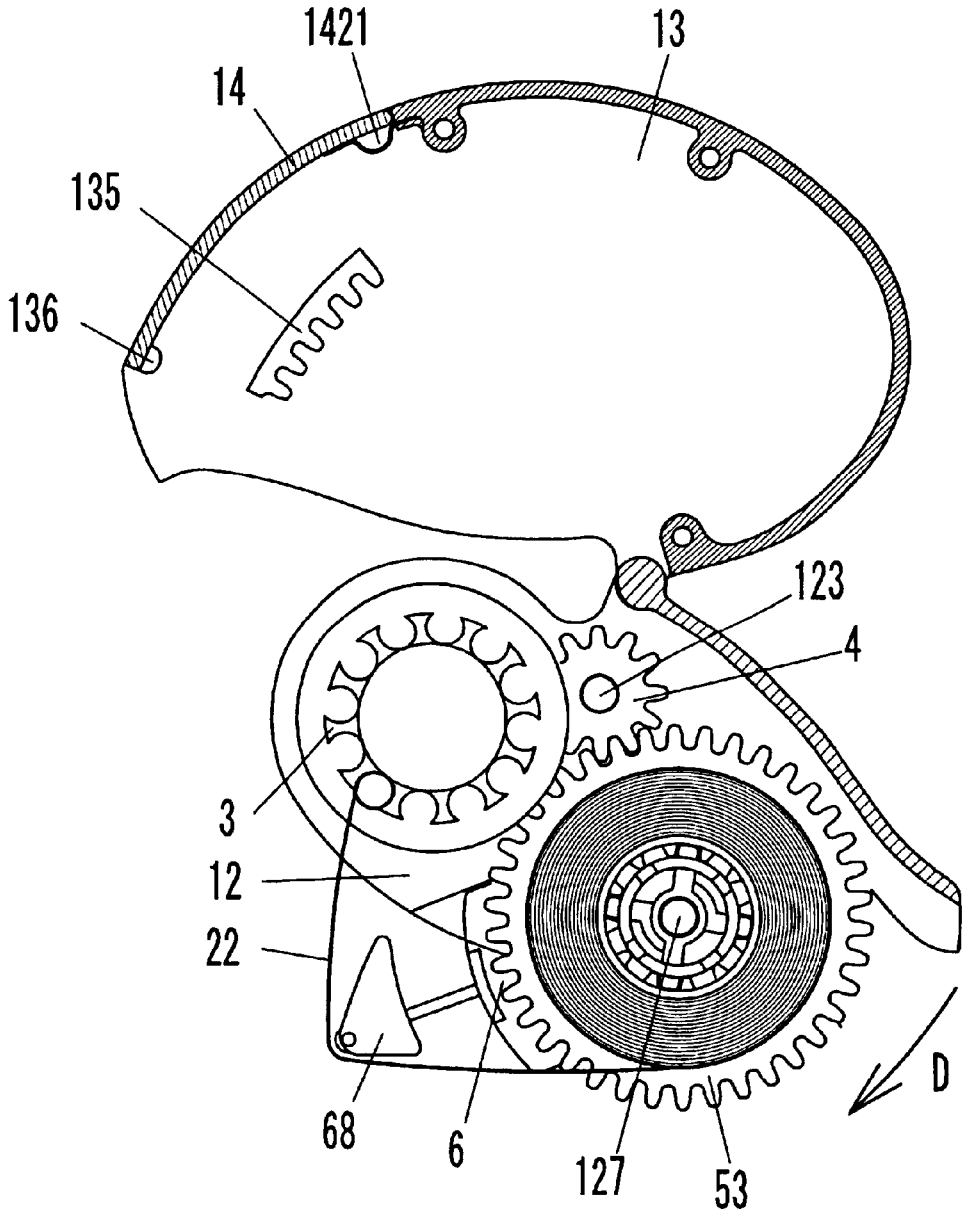
FIG. 18 is a view showing the operations of the respective members when replacing coating film transfer tapes.

In this state, since the coating film transfer tape 22 is disengaged from the head 68, the head 68 being located at a position between the supply reel 5 and the take-up reel 3, the coating film transfer tape that has been used up can be removed from the supply reel 5 and the take-up reel 3 for replacement with a refill coating film transfer tape. This embodiment describes a case in which coating film transfer tapes of the aforesaid holder type are replaced. As shown in FIG. 17, are fill coating film transfer tape mounted on the baseboard 71 is mounted with the respective members being aligned with their mounting positions, and thereafter the baseboard 71 is removed by pinching a tab 714, whereby the replacement of the coating film transfer tapes is completed. As shown in FIG. 18, while the coating film transfer tape so replaced is still in a slack state in the state in which the base board 71 is removed, since the tape is hooked on an external portion of the head, there is no need to correct the position thereof.

Figure 19:
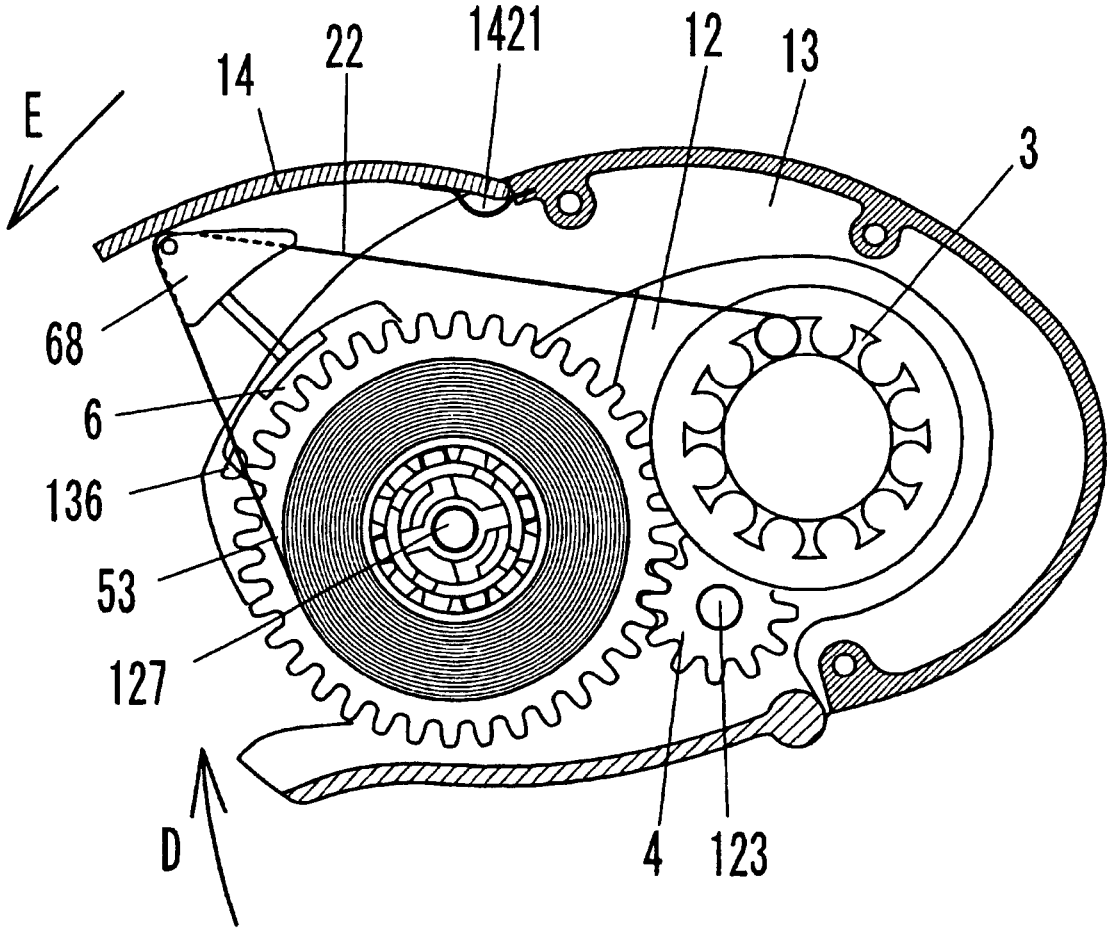
FIG. 19 is a view showing the operations of the respective members when replacing coating film transfer tapes.
Figure 20:
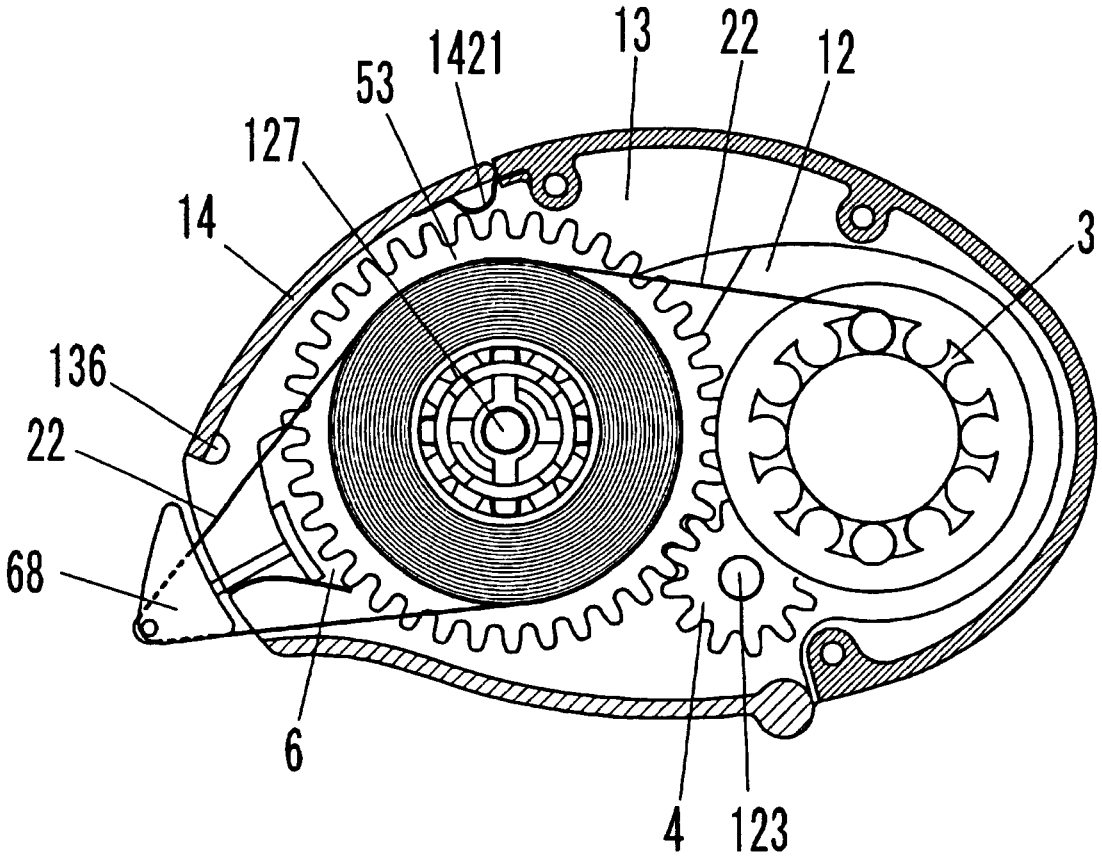
FIG. 20 is a view showing the operations of the respective members when replacing coating film transfer tapes.
Figure 21:
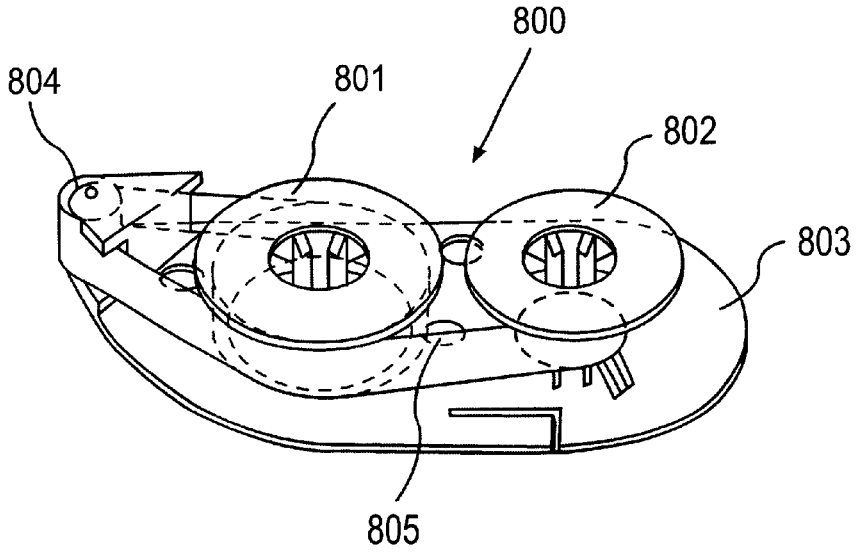
FIG. 21 PRIOR ART
FIG. 21 is a view showing the construction of a conventional refill coating film transfer tape.
Figure 22:
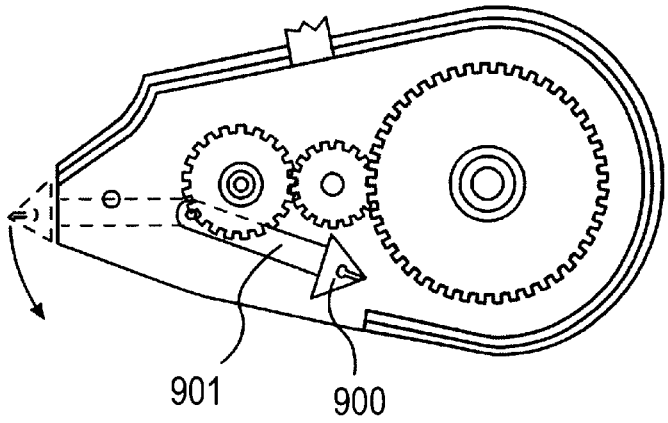
FIG. 22 PRIOR ART
FIG. 22 is a view showing the construction of a conventional coating film transfer tool.
Figure 23:
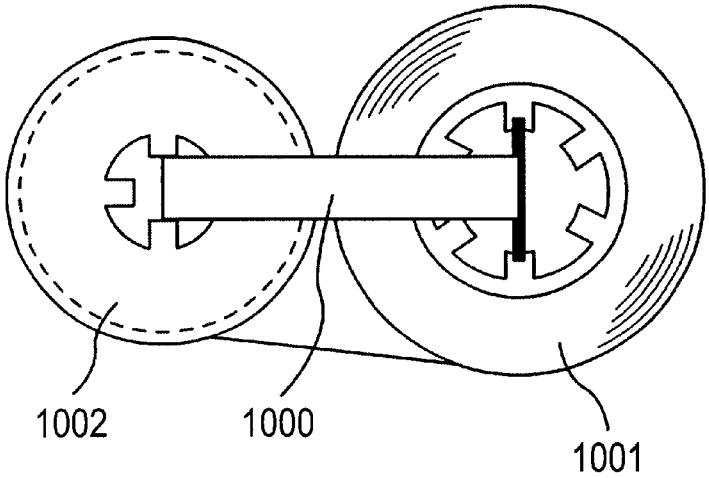
FIG. 23 PRIOR ART
FIG. 23 is a view showing a refill coating film transfer tape for use with the coating film transfer tool shown in FIG. 22.
Figure 24:
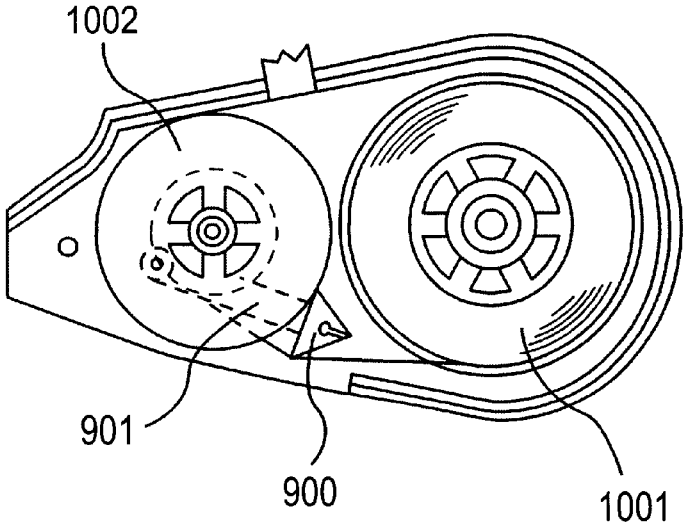
FIG. 24 PRIOR ART
FIG. 24 is a view showing the replacement of coating film transfer tapes in the conventional coating film transfer tool.

When the supporting body is rotated in a direction indicated by an arrow D with the aforesaid state being maintained as it is, as shown in FIG. 19, since the head retaining portion 6 rotates in a direction indicated by an arrow E, a distance between the head 68 and the take-up reel 3 is prolonged, whereby the coating film transfer tape 22 is brought into tight engagement with the head 68. Then, when the supporting body 12 rotates further and is accommodated back into the main body case the coating film transfer tape 22 is extended over the head 68 and is put in a tight state, when the head 68 is returned to the same position as that it took before it was rotated, whereby all the replacement work is completed.

Thus, with the coating film transfer tool according to the present invention, all the replacement work is completed through the three operations such as ① opening the supporting member, ② replacing the coating film transfer tapes and ③ closing the supporting body, and the procedure of implementing the operations is clear and simple.

In addition, with respect to the members to be replaced, members that have to be replaced together with the coating film transfer tape are the tape core and the tape locking body only, and therefore the coating film transfer tool according to the present invention contributes to conservation of the resources and reduction in amount of wastes.

Thus, while what has been described heretofore is the construction of the embodiment according to the present invention, the coating film transfer tool according to the present invention may be constructed as below.

A main body case constructed to be divided into two case members such as an upper case and a lower case is provided on a coating film transfer tool main body in such a manner that the upper case can be rotated manually relative to the lower case. Then, a rack is formed in the interior of the upper case, and provided on the lower case are a head retaining body adapted to rotate about a mounting shaft, a supply reel to which a coating film transfer tape is detachably attached, a take-up reel around which the coating film transfer tape that has been used up is wound and a transfer mechanism for interlocking the supply reel and the take-up reel. Then, when assembling the case which is designated as the upper case the upper case is disposed in such a manner that the rack and a gear portion provided on the head retaining body mesh with each other, and the head retaining body is constructed to rotate over a predetermined section when the case is opened and/or closed.

According to the construction, when the main body case is rotated in one direction to be opened the head automatically rotates to be disengaged from the coating film transfer tape, and at the same time the supply reel and the take-up reel are exposed out of the case so that the used-up coating film transfer tape is removed therefrom for replacement with a refill coating film transfer tape. On the contrary, when the main body case is rotated in the opposite direction so that the main body case is closed the head not only automatically rotates in an opposite direction to be brought into engagement with the refill coating film transfer tape so replaced but also returns to the same position as that the head took before it was rotated.

According to this construction, the coating film transfer tool can be provided which can implement the replacement work as easily as the preceding embodiment.

The present invention is implemented in the modes that have been described above and provides the following effectiveness.

According to the present invention, with the aforesaid construction the operations of the main body case, the head retaining body and the respective members provided in the main body case can be interlocked with each other. Namely, by opening one of the main body case members by rotating it relative to the other case member the head automatically rotates to be disengaged from the coating film transfer tape and at the same time the supporting body moves out of the case, so that the coating film transfer tape that has been used up can be removed therefrom for replacement with a refill coating film transfer tape. Then, by closing the one of the main body case members by rotating it in the opposite direction the head not only automatically rotates in the opposite direction to be brought into engagement with the refill coating film transfer tape so replaced but also returns to the same position as that the main body case member took before it was rotated. According to the construction, the user can complete the replacement of the coating film transfer tapes only by opening the main body case, replacing the used-up coating film transfer tape with the refill coating film transfer tape, and closing the main body case. Thus, the necessity of the cumbersome operations which used to be manually individually implemented can be obviated, whereby the operations required for replacement of coating film transfer tapes can extremely be simplified.

In addition, according to the present invention, with the aforesaid construction the operations of the supporting body, the head retaining body and the respective members provided on the supporting body can be interlocked with each other. Namely, by opening the supporting body from the main body case by rotating it in one direction the respective members on the supporting body automatically operate in a connected fashion, whereby the user can complete the replacement of the coating film transfer tapes only by removing the used-up coating film transfer tape and replacing it with a refill coating film transfer tape. Thus, the necessity of the cumbersome operations which used to be manually individually implemented can be obviated, whereby the operations required for replacement of coating film transfer tapes can extremely be simplified.

Furthermore, according to present invention, with the aforesaid construction, the operations of the head retaining body, the supply reel and the take-up reel can be interlocked with each other, whereby only by opening the supporting body from the main body case by rotating it in the one direction the respective members on the supporting body can be operated in an interlocked fashion. According to this construction, when replacing coating film transfer tapes the user only has to replace the coating film transfer tape that has been used up with the refill coating film transfer tape, and hence the necessity is obviated of performing adjustment work such as moving individually the constituent members provided in the interior of the coating film transfer tool for eliminating the slack of the refill coating film transfer tape so replaced. Thus, the necessity of performing the adjustment work that used to be individually performed by the user when replacing coating film transfer tapes can be obviated, whereby the operations required for replacement of coating film transfer tapes can extremely be simplified.

Moreover, according to the present invention, when the supporting body is drawn from the main body case by rotating it in the one direction when coating film transfer tapes are replaced interlocking with the operation of the supporting body, the head retaining body automatically rotates. As this occurs, the head not only automatically rotates to move into between the supply reel and the take-up reel but also operates to be disengaged from the coating film transfer tape. Thus, the user is not required intentionally to disengage the coating film transfer tape from the head and to move the head to a position that does not disrupt the replacement of coating film transfer tapes, whereby the user can complete the replacement of coating film transfer tapes extremely easily.

In addition, according to the fifth aspect of the present invention, when replacing coating film transfer tapes by accommodating the supporting body back in the main body case by rotating the supporting body in the opposite direction interlocking with the operation of the supporting body, the head retaining body automatically rotates in the opposite direction. As this occurs, the heat is brought into engagement with the refill coating film transfer tape so replaced, and the supply reel and the take-up reel, which are interlocked with the head retaining body, rotate to remove the slack of the coating film transfer tape. Thus, the user is not required intentionally to bring the coating film transfer tape into engagement with the head and to adjust the slack of the coating film transfer tape, whereby the user can complete the replacement of the coating film transfer tapes extremely easily.

According to the present invention, when the supporting body is rotated in the one direction to replace coating film transfer tapes the head or the part of the supporting body comes into contact with the rotating wall, and as this occurs, the rotating wall is moved without disrupting the operation of the supporting body. Then, when the supporting body is rotated in the opposite direction after the replacement of the coating film transfer tapes has been completed the rotating wall also comes into contact with the supporting body and is moved without disrupting the operation of the supporting body. As this series of operations occurs, since the biasing mechanism is provided on the rotating wall, a force is always applied to the rotating wall in a direction in which the rotating wall is returned to its original position, whereby the rotating wall is prevented from being left in an opened state.

In addition, according to the present invention, with the aforesaid construction the replacement of the coating film transfer tapes can be facilitated. Namely, the user can complete the replacement of the coating film transfer tapes only by performing operations of rotating the supporting body in the one direction so as to draw it from the main body case for removal of the coating film transfer tape that has been used up, attaching the refill coating film transfer tape to the supply reel after the used-up coating film transfer tape has been removed with the tape locking body being attached to the take-up reel, and rotating the supporting body in the opposite direction so as to accommodate the supporting body back in the main body case.

What is claimed is:

1. A coating film transfer tool for use to transfer a transfer layer provided on a side of a tape in a strippable state to a coating film receiving surface, characterized in that a main body case constructed in such a manner as to be divided into at least two separate case members is provided on a coating film transfer tool main body, and that one of said two case members is disposed manually rotatably relative to the other case member, said one case member comprising a head retaining body adapted to be interlocked with the operation of said one case member for rotation, a supply reel to which a coating film transfer tape is detachably attached, a take-up reel for taking up said coating film transfer tape after said tape has been used up, and a transfer mechanism for interlocking said supply reel and said take-up reel, whereby by opening said one case member by rotating it in one direction a head automatically rotates to be disengaged from said coating film transfer tape and at the same time said supply reel and said take-up reel become exposed out of said main body case so that said used-up coating film transfer tape is removed therefrom for replacement with a refill coating film transfer tape, whereas by closing said one case member by rotating it in an opposite direction said head not only rotates automatically in an opposite direction to engage with said refill coating film transfer tape so replaced but also is allowed to return to the same position as that said head took before it was moved.

2. A coating film transfer tool for use to transfer a transfer layer provided on a side of a tape in a strippable state to a coating film receiving surface, characterized in that a main body case and a supporting body provided manually rotatably in the interior of said case main body are provided on a coating film transfer tool main body, said supporting body comprising a head retaining body adapted to be interlocked with the operation of said supporting body for rotation, a supply reel to which a coating film transfer tape is detachably attached, a take-up reel for taking up said coating film transfer tape after said tape has been used up, and a transfer mechanism for interlocking said supply reel and said take-up reel, whereby by drawing said supporting body from said main body case by rotating it in one direction a head automatically rotates to be disengaged from said coating film transfer tape and at the same time said supporting body moves out of said main body case so that said used-up coating film transfer tape is removed therefrom for replacement with a refill coating film transfer tape, whereas by accommodating said supporting body back in said main body case by rotating it in an opposite direction said head not only rotates automatically in an opposite direction to engage with said refill coating film transfer tape so replaced but also is allowed to return to the same position as that said head took before it was moved.

3. A coating film transfer tool as set forth in claim 2, wherein said head retaining body is provided with a gear adapted to mesh with a rack provided on said main body case and a ratchet adapted to interlock with said supply reel, wherein said supply reel of said supporting body, to which a coating film transfer tape is detachably attached, is provided with a gear having a center axis concentric with a rotational center axis of said supply reel and a pawl adapted to be locked in said ratchet provided on said head retaining body, wherein said take-up reel for taking up a coating film transfer tape after said tape has been used up is provided with a gear having a center axis concentric with a rotational center axis of said take-up reel, and wherein an intermediate gear is provided on said supporting body for interlocking said gears with each other which are provided on said supply reel and said take-up reel, respectively.

4. A coating film transfer tool as set forth in claim 3, wherein when said supporting body is rotated in one direction to be drawn out of said main body case said head automatically rotates to move into between said supply reel and said take-up reel and is automatically disengaged from said coating film transfer tape.

5. A coating film transfer tool as set forth in claim 3, wherein when said supporting body is rotated in the opposite direction to be accommodated back in said main body case said head automatically rotates in the opposite direction not only to engage with a refill coating film transfer tape so replaced but also to remove the slack of said coating film transfer tape.

6. A coating film transfer tool as set forth in claim 3, wherein a rotating wall adapted to rotate relative to said main body case is provided on said main body case positioned on a rotating locus of said supporting body, and wherein a biasing mechanism is provided on said rotating wall for automatically returning said rotating wall from a rotated position to the position said rotating wall took before it was rotated.

7. A coating film transfer tool as set forth in claim 2, wherein when said supporting body is rotated in one direction to be drawn out of said main body case said head automatically rotates to move into between said supply reel and said take-up reel and is automatically disengaged from said coating film transfer tape.

8. A coating film transfer tool as set forth in claim 7, wherein when said supporting body is rotated in the opposite direction to be accommodated back in said main body case said head automatically rotates in the opposite direction not only to engage with a refill coating film transfer tape so replaced but also to remove the slack of said coating film transfer tape.

9. A coating film transfer tool as set forth in claim 7, wherein a rotating wall adapted to rotate relative to said main body case is provided on said main body case positioned on a rotating locus of said supporting body, and wherein a biasing mechanism is provided on said rotating wall for automatically returning said rotating wall from a rotated position to the position said rotating wall took before it was rotated.

10. A coating film transfer tool as set forth in claim 2, wherein when said supporting body is rotated in the opposite direction to be accommodated back in said main body case said head automatically rotates in the opposite direction not only to engage with a refill coating film transfer tape so replaced but also to remove the slack of said coating film transfer tape.

11. A coating film transfer tool as set forth in claim 10, wherein a rotating wall adapted to rotate relative to said main body case is provided on said main body case positioned on a rotating locus of said supporting body, and wherein a biasing mechanism is provided on said rotating wall for automatically returning said rotating wall from a rotated position to the position said rotating wall took before it was rotated.

12. A coating film transfer tool as set forth in claim 2, wherein a rotating wall adapted to rotate relative to said main body case is provided on said main body case positioned on a rotating locus of said supporting body, and wherein a biasing mechanism is provided on said rotating wall for automatically returning said rotating wall from a rotated position to the position said rotating wall took before it was rotated.

13. A method for replacing coating film transfer tapes for use in a coating film transfer tool for use to transfer a transfer layer provided on a side of a tape in a strippable state to a coating film receiving surface, characterized in that a main body case and a supporting body provided manually rotatably in the interior of said case main body are provided on a coating film transfer tool main body, said supporting body comprising a head retaining body adapted to be interlocked with the operation of said supporting body for rotation, a supply reel to which a coating film transfer tape is detachably attached, a take-up reel for taking up said coating film transfer tape after said tape has been used up, and a transfer mechanism for interlocking said supply reel and said take-up reel, whereby by drawing said supporting body from said main body case by rotating it in one direction a head automatically rotates to be disengaged from said coating film transfer tape and at the same time said supporting body moves out of said main body case so that said used-up coating film transfer tape is removed therefrom for replacement with a refill coating film transfer tape, whereas by accommodating said supporting body back in said main body case by rotating it in an opposite direction said head not only rotates automatically in an opposite direction to engage with said refill coating film transfer tape so replaced but also is allowed to return to the same position as that said head took before it was moved, said method comprising the operations of rotating said supporting body in one direction to draw it from said main body case so as to remove a coating film transfer tape that has been used up, attaching a refill coating film transfer tape to said supply reel and said take-up reel after said used-up coating film transfer tape has been removed, and rotating said supporting body in the opposite direction to return said supporting body back into said main body case.

* * * * *